US010975312B2

(12) United States Patent
Lin et al.

(10) Patent No.: US 10,975,312 B2
(45) Date of Patent: Apr. 13, 2021

(54) PROCESS FOR ONE-POT LIQUEFACTION OF BIOMASS OR COAL AND BIOMASS

(71) Applicant: BEIJING SANJU ENVIRONMENTAL PROTECTION & NEW MATERIALS CO., LTD, Beijing (CN)

(72) Inventors: Ke Lin, Beijing (CN); Lin Li, Beijing (CN); Lixin Guo, Beijing (CN)

( * ) Notice: Subject to any disclaimer, the term of this patent is extended or adjusted under 35 U.S.C. 154(b) by 0 days.

(21) Appl. No.: 16/537,527

(22) Filed: Aug. 10, 2019

(65) Prior Publication Data

US 2019/0359892 A1 Nov. 28, 2019

Related U.S. Application Data

(63) Continuation of application No. PCT/CN2018/122665, filed on Dec. 21, 2018.

(30) Foreign Application Priority Data

| | | |
|---|---|---|
| Dec. 25, 2017 | (CN) | 201711419221.2 |
| Dec. 25, 2017 | (CN) | 201711420263.8 |
| Dec. 25, 2017 | (CN) | 201711420278.4 |
| Dec. 25, 2017 | (CN) | 201711421720.5 |
| Dec. 26, 2017 | (CN) | 201711429908.4 |
| Dec. 26, 2017 | (CN) | 201711430518.9 |

(51) Int. Cl.
*C10G 1/06* (2006.01)
*C10L 1/32* (2006.01)

(52) U.S. Cl.
CPC ..... *C10G 1/06* (2013.01); *C10L 1/326* (2013.01); *C10G 2300/1014* (2013.01); *C10L 2200/0484* (2013.01); *C10L 2290/544* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,623,102 | B2 | 1/2014 | Quignard et al. | |
| 2011/0167713 | A1 | 7/2011 | Quignard et al. | |
| 2017/0362416 | A1* | 12/2017 | Srinivasan | C08L 9/06 |
| 2018/0023014 | A1 | 1/2018 | Li | |

FOREIGN PATENT DOCUMENTS

| | | | |
|---|---|---|---|
| CA | 1294236 | C | 1/1992 |
| CN | 1544580 | A | 11/2004 |
| CN | 101805629 | A | 8/2010 |
| CN | 101899314 | A | 12/2010 |
| CN | 102443130 | A | 5/2012 |
| CN | 103148498 | A | 6/2013 |
| CN | 103242871 | A | 8/2013 |
| CN | 104927948 | A | 9/2015 |
| CN | 104962331 | A | 10/2015 |
| CN | 106967469 | A | 7/2017 |
| CN | 108251150 | A | 12/2017 |
| CN | 108085042 | A | 5/2018 |
| CN | 108219818 | A | 6/2018 |
| CN | 108219819 | A | 6/2018 |
| CN | 108264916 | A | 7/2018 |
| CN | 108264920 | A | 7/2018 |
| EP | 0182309 | A | 11/1984 |
| WO | 2016124148 | A1 | 8/2016 |

OTHER PUBLICATIONS

European Search Report of European Patent Application No. 18896217.9.
Second Office Action of Chinese Application No. 2017114217205.
Internation Search Report of PCT/CN2018/122665, dated Mar. 26, 2019.
Priority Document CN2017114217205_Decision of Refusal dated Nov. 13, 2019.
Written Opinion of PCT/CN2018/122665, dated Mar. 26, 2019.
OA1 of priority CN2017114217205, dated Mar. 9, 2019.
OA1 of priority CN2017114305189, dated Mar. 8, 2019.
OA1 of priority CN2017114202784, dated Mar. 18, 2019.
OA1 of priority CN2017114299084, dated Jan. 31, 2019.
OA1 of priority CN2017114192212, dated Mar. 15, 2019.
OA1 of priority CN2017114202638, dated Mar. 8, 2019.
OA1 of priority CN2017114202638, dated May 20, 2019.
OA2 of priority CN2017114299084, dated Mar. 20, 2019.
OA2 of priority CN2017114202638, dated May 10, 2019.
"Research progress and prospects of biomass solidification briquetting technology" 74 Engineering Sciences.
Decision of Rejection of priority CN2017114299084, dated May 30, 2019.
Decision of Rejection of priority CN2017114202638, dated Aug. 9, 2019.

(Continued)

*Primary Examiner* — Ellen M McAvoy
*Assistant Examiner* — Chantel L Graham
(74) *Attorney, Agent, or Firm* — W&K IP

(57) ABSTRACT

Disclosed is a process for the one-pot liquefaction of a biomass or coal and a biomass, the process comprising: first preparing a slurry containing a catalyst, a vulcanizing agent and a biomass (and coal), and then introducing hydrogen gas into the slurry to carry out a reaction. Preparing the slurry comprises: subjecting a biomass (and coal) sequentially to drying, a first pulverization, compression and a second pulverization, then mixing same with a catalyst and a vulcanizing agent to obtain a mixture, and adding the mixture to an oil product for grinding and pulping to obtain a biomass slurry. By means of the treatment process of subjecting the straw firstly to compression and then to a second pulverization, the volume of the straw is greatly reduced, thereby facilitating the dispersion thereof in the oil product.

37 Claims, No Drawings

(56) References Cited

OTHER PUBLICATIONS

OA3 of priority CN2017114217205, dated Aug. 15, 2019.
OA2 of priority CN2017114305189, dated Aug. 21, 2019.
OA2 of priority CN2017114192212, dated Aug. 21, 2019.
Subcritical Supercritical Water Technique and Principle, 2014.
First Office Action of European Patent Application No. 18896217.9.

* cited by examiner

PROCESS FOR ONE-POT LIQUEFACTION OF BIOMASS OR COAL AND BIOMASS

CROSS-REFERENCE TO RELATED APPLICATIONS

This application is a continuation of International Patent Application No. PCT/CN2018/122665 with an international filing date of Dec. 21, 2018, designating the United States, now pending, and further claims priority benefits to Chinese Patent Applications No. 201711421720.5, filed on Dec. 25, 2017, Chinese Patent Applications No. 201711420278.4, filed on Dec. 25, 2017, Chinese Patent Applications No. 20171111419221.2, filed on Dec. 25, 2017, Chinese Patent Applications No. 201711420263.8, filed on Dec. 25, 2017, Chinese Patent Applications No. 201711430518.9, filed on Dec. 26, 2017, and Chinese Patent Applications No. 201711429908.4, filed on Dec. 26, 2017. The contents of all of the aforementioned applications, including any intervening amendments thereto, are incorporated herein by reference.

TECHNICAL FIELD

The present invention relates to the technical field of biological energy conversion, and particularly to a process for one-pot liquefaction of biomass or coal and biomass.

BACKGROUND

With rapid development of the social economy, the non-renewable fossil energy, such as coal, crude oil, natural gas, oil shale, etc., is exhausted gradually, and environmental pollution caused by contaminants, such as $CO_2$, $SO_2$, $NO_x$, etc., generated after the fossil non-renewable energy is burnt, is increasingly serious, so that the human beings have to seriously consider energy access ways and environment improvement methods. Biomass is a renewable energy, which has huge potential and advantages in the aspects of meeting energy demands, reducing environment pollution and improving energy structure. Biomass refers to all organic substances formed by directly or indirectly using the photosynthesis of green plants, including plants, animals, microorganisms and excretions and metabolites thereof, and biomass has renewability, low pollution and wide distribution. In recent years, conversion and utilization of biomass energy are developing towards high efficiency and cleanness, and biomass liquefaction technology is one of the important points. The liquefaction mechanism is as follows: biomass is firstly pyrolyzed into oligomers, and then subjected to dehydration, dehydroxylation, dehydrogenation, deoxygenation and decarboxylation to form small molecule compounds, which are then subjected to reactions such as condensation, cyclization, polymerization, etc. to form new compounds. The existing biomass liquefaction process mainly comprises indirect liquefaction and direct liquefaction. Direct liquefaction is to directly liquefy solid biomass to liquid by carrying out hydrolysis and supercritical liquefaction or introducing hydrogen, inert gas, etc. under a suitable temperature and a suitable pressure in the presence of a solvent or a catalyst. Biomass direct liquefaction process mainly comprises pyrolysis liquefaction, catalytic liquefaction, pressurized hydroliquefaction, etc., among which pressurized hydroliquefaction has high products yield and good quality. Pressurized hydroliquefaction generally comprises complex procedures, such as solid material drying, crushing, slurry preparing, heating, pressurizing, reacting, separating, etc. For example, Chinese patent application CN103242871A discloses a heavy oil and biomass hydrogenation co-liquefaction treatment process, which comprises pre-pulverizing a dried biomass to 40-100-mesh and mixing it with a heavy oil to form a slurry, adding a catalyst and a vulcanizing agent into the slurry, placing the resulted mixture in a slurry bed hydrogenation reactor to undergo hydrogenation and thermal cracking reactions under a temperature of 370-430° C. and a hydrogen partial pressure of 4-8 MPa, and fractioning the reaction product, thereby obtaining a bio-oil and coke.

The above-mentioned process realizes the conversion of biomass to bio-oil, but in the above technique there are some problems. In one respect, the slurry formed from biomass and heavy oil needs to be pumped to the slurry bed hydrogenation reactor. However, most biomass (for example straw) has low specific gravity due to its abundant porosity, making it difficult to dissolve in the biomass liquefaction solvent, resulting in lower concentration of biomass in the slurry (the biomass in the above technology only accounts for 5-20 wt % of the mass of the heavy oil), which results in a limited amount of biomass transport per unit time, thus, the above hydrogenation co-liquefaction process has lower production efficiency, higher industrial costs, and higher energy consumption. In another respect, biomass with porosity is easy to float on the surface of the liquefied solvent, furthermore, heavy oil used as a slurry solvent has large viscosity, making the slurry being difficult to flow, which easily causes blockage of the conveying pipe, so it is difficult to achieve smooth transportation by the pump. Although in the prior art, researchers attempt to add dispersing agent to the slurry to increase the concentration and dispersion of biomass in the slurry, but the adding of dispersing agent often affects the quality of the bio-oil. In addition, the biomass has a low conversion rate in the above technology (the conversion rate is only about 90%). Therefore, a technical problem to be urgently solved by those skilled in the art is to improve the existing biomass liquefaction process so as to increase the concentration of biomass in the slurry, increase the pumping capacity of the biomass per unit time, achieve smooth pumping, reduce energy consumption, and increase biomass conversion rate.

SUMMARY OF THE INVENTION

Therefore, the present invention aims to overcome the problems of low biomass transport by the pumps, unstable transportation, low biomass conversion rate and high energy consumption in the prior biomass liquefaction process, and further to provide a process for one-pot liquefaction of biomass or coal and biomass.

For this purpose, the above-mentioned object of the present invention is achieved by the following technical solutions:

In one aspect, the present invention provides a first technical solution for one-pot liquefaction process for biomass, comprising the following steps:

preparing a slurry containing a catalyst, a vulcanizing agent and a biomass, and introducing hydrogen into the slurry to carry out a reaction under a pressure of 15-25 MPa and a temperature of 380-480° C., thereby obtaining a bio-oil;

wherein, the slurry is prepared with using straw as the biomass according to the following steps: subjecting the straw sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a straw concentration of 30 wt % to 60 wt %.

The straw raw material in the present invention can be selected form the group consisting of straw of cereal crops, such as wheat, rice, corn, reed, sorghum, millet, etc., and can also be straw of leguminous plants such as soybean, adzuki bean, mung bean, broad bean, pea, etc., and can also be straw of fiber crops, such as cotton, flax, ramie, and any combination thereof.

Said subjecting the straw to compression is carried out under a pressure of 0.5-3 MPa and a temperature of 30-60° C.

Said subjecting the straw to drying is carried out at a temperature of 50-70° C. for a period of 3-5 h to obtain a dried straw having a moisture content of less than 2 wt %, and after the first pulverization the dried straw has a median particle size of 100-300 μm, and after the second pulverization the dried straw has a median particle size of 30-50 μm and a bulk density of 400-500 kg/m$^3$.

The slurry has a viscosity of 500-1400 mPa·s (50° C.).

The slurry has a straw content of 55-60 wt %.

The oil is selected from the group consisting of waste animal and vegetable oil, waste mineral oil, mineral oil, distillate oil, and any combination thereof.

Further, the waste animal and vegetable oil is selected from the group consisting of gutter oil, hogwash oil, sour oil, and any combination thereof.

The waste mineral oil is a waste lubricating oil and/or a waste engine oil.

The mineral oil is selected from the group consisting of heavy oil, residual oil, anthracene oil, washing oil, and any combination thereof.

The grinding pulping is stirring pulping, dispersing pulping, emulsifying pulping, shearing pulping, or homogeneous pulping.

The catalyst is selected from the group consisting of amorphous FeOOH, amorphous alumina loading an active component, biomass charcoal loading an active component, and any combination thereof, and wherein the active component is selected from the group consisting of oxides of metals of group VIB, group VIIB, group VIII, and any combination thereof in the periodic table of elements.

The active component is selected from the group consisting of oxides of Mo, W, Fe, Co, Ni, Mn, Pd and any combination thereof.

The catalyst is present in an amount of 1-10 wt %, preferably 1-4 wt % of the mass of the pretreated biomass, and has a particle size of 5-500 μm; and the vulcanizing agent is present in an amount of 0.1-0.4 wt % of the mass of the pretreated biomass.

Said introducing hydrogen into the slurry comprises: introducing a high-pressure hydrogen into the slurry to prepare a reaction raw material mixture, wherein the high-pressure hydrogen and the slurry have a volume ratio of (600-1500):1; and heating the reaction raw material mixture to 380-480° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.02-0.2 m/s, preferably 0.05-0.08 m/s; wherein, the high-pressure hydrogen has a pressure of 13-25 MPa, and the cold hydrogen has a temperature of 60-135° C.

Said introducing the high-pressure hydrogen into the slurry comprises two steps of: firstly, introducing a high-pressure hydrogen into the slurry till the volume ratio of the high-pressure hydrogen to the slurry is (50-200):1, and heating the slurry to 200-350° C., and secondly, introducing a high-pressure hydrogen into the slurry.

The cold hydrogen is injected via 3-5 injection ports which are sequentially formed in a height direction in a side wall of the slurry bed reactor.

The catalyst stored in the slurry bed reactor is controlled in an amount of 5-30 wt % of the mass of liquid phase in the slurry bed reactor; and the reaction is carried out for a period of 30-120 min.

The biomass charcoal loading with an active component is prepared by a method comprising: S1, carrying out acidification or alkalization on biomass charcoal to produce a biomass charcoal support; and S2, mixing the biomass charcoal support with an active component, followed by grinding to produce the biomass charcoal loading the active component.

The active component is selected from the group consisting of oxides of Mo, W, Fe, Co, Ni, Mn, Pd, and any combination thereof, and based on mass of metal elements, the active component accounts for 1-5% of the mass of the biomass charcoal support.

Said mixing and grinding the biomass charcoal support with an active component comprises the steps of: carrying out vibration grinding and/or plane grinding and/or ball milling on the active component and the biomass charcoal support, thereby obtaining the biomass charcoal loading the active component and having a particle size of 5-500 μm.

The acidification is carried out with an acid medium which has a $H^+$ concentration of 0.5-5 mol/L. A volume ratio of the carbonized biomass charcoal to the acid medium is (1:5)-(1:15). The acidification is carried out at a temperature of 30-80° C. for a period of 1-10 h, The alkalization is carried out with an alkaline medium which has an $OH^-$ concentration of 0.5-5 mol/L. A volume ratio of the carbonized biomass charcoal to the alkaline medium is (1:5)-(1:15). The alkalization is carried out at a temperature of 30-80° C. for a period of 1-10 h.

The vulcanizing agent can be sulfur, carbon disulfide or dimethyl disulfide.

In a second aspect, the present invention also provides a second technical solution for one-pot liquefaction process for biomass, comprising the following steps:

preparing a slurry containing a catalyst, a vulcanizing agent and a biomass, and introducing hydrogen into the slurry to carry out a reaction under a pressure of 13-25 MPa and a temperature of 300-500° C., thereby obtaining a bio-oil.

The catalyst comprises amorphous alumina loading a first active component, or biomass charcoal loading a first active component, wherein the first active component is selected from the group consisting of oxides of metals of group VIB, group VIIB, group VIII, and any combination thereof in the periodic table of elements.

The catalyst further comprises amorphous FeOOH, and/or biomass charcoal loading a second active component, wherein the second active component is selected from the group consisting of oxides of Mo, W, Fe, Co, Ni, Pd, and any combination thereof. The catalysts can be either used alone or used in combination. When used in combination, a mass ratio of the iron oxyhydroxide to the biomass charcoal loading a second active component is 0.5-5.

The vulcanizing agent specifically can be but not limited to sulfur or dimethyl sulfide. Any compound capable of converting the active component in the catalyst from oxides into corresponding sulfides can be taken as the vulcanizing agent. In the present invention, the vulcanizing agent is present in an amount of 4-10 wt % of the mass of the catalyst.

The slurry has a biomass content of 10-50 wt %, preferably 30-40 wt %.

The catalyst is present in an amount of 1-10 wt %, preferably 1-4 wt % of the mass of the biomass, and has a particle size of 5-500 μm.

The slurry is prepared by:

adding the catalyst and the vulcanizing agent respectively into a liquid biomass to form the slurry, wherein the liquid biomass is selected from the group consisting of vegetable oil, animal oil, gutter oil, animal wastes, and any combination thereof; or drying, pulverizing and removing dust from a solid biomass, followed by mixing with a catalyst and a vulcanizing agent to obtain a mixture; and adding the mixture to an oil to form a slurry, wherein the oil is selected from the group consisting of vegetable oil, animal oil, coal tar, petroleum, the bio-oil prepared by the process in the present invention, and any combination thereof.

The solid biomass raw material can be straw of crops, such as wheat, rice, corn, cotton, etc., or industrial crops, such as reed, pennisetum sinese, trees, tree leaves, melons, fruits, vegetables, etc., or algae, industrial wood and paper wastes, etc.; and the solid biomass raw material may be one biomass, or a biomass raw material consisting of various biomass.

The dried solid biomass has a moisture content of 3-15 wt %, preferably 5-10 wt %; and the pulverized solid biomass has a particle size of 1-5000 μm, preferably 20-1500 μm.

Said introducing hydrogen into the slurry comprises:

introducing a high-pressure hydrogen into the slurry to prepare a reaction raw material mixture, wherein the high-pressure hydrogen and the slurry have a volume ratio of (600-1500):1; and heating the reaction raw material mixture to 320-450° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.02-0.2 m/s, preferably 0.05-0.08 m/s;

wherein, the high-pressure hydrogen has a pressure of 13-27 MPa, and the cold hydrogen has a temperature of 60-135° C.

Said introducing the high-pressure hydrogen into the slurry comprises two steps of:

firstly, introducing a high-pressure hydrogen into the slurry till the volume ratio of the high-pressure hydrogen to the slurry is (50-200):1, and heating the slurry to 200-350° C., and secondly, introducing a high-pressure hydrogen into the slurry.

The cold hydrogen is injected via 3-5 injection ports which are sequentially formed in a height direction in a side wall of the slurry bed reactor.

The catalyst stored in the slurry bed reactor is controlled in an amount of 5-30 wt % of the mass of liquid phase in the slurry bed reactor; and the reaction is carried out for a period of 15-90 min.

The biomass charcoal loading a second active component is prepared by:

S1, carrying out acidification or alkalization on carbonized biomass charcoal to produce a biomass charcoal support; and S2, mixing the biomass charcoal support with a second active component, followed by grinding to produce a biomass charcoal loading a second active component.

The second active component is selected from the group consisting of oxides of Mo, W, Fe, Co, Ni and Pd, and based on mass of metal elements, the second active component accounts for 1-5 wt % of the mass of the second biomass charcoal support.

Said mixing and grinding the second biomass charcoal support with the second active component comprises: carrying out vibration grinding and/or plane grinding and/or ball milling on the second active component and the second biomass charcoal support, thereby obtaining biomass charcoal loading a second active component and having a particle size of 5-500 μm.

The acidification is carried out with an acid medium which has a $H^+$ concentration of 0.5-5 mol/L. A volume ratio of the carbonized biomass charcoal to the acid medium is (1:5)-(1:15), and the acidification is carried out at a temperature of 30-80° C. for a period of 1-10 h. The alkalization is carried out with an alkaline medium which has an $OH^-$ concentration of 0.5-5 mol/L. A volume ratio of the carbonized biomass charcoal to the alkaline medium is (1:5)-(1:15), and the alkalization is carried out at a temperature of 30-80° C. for a period of 1-10 h.

In a third aspect, the present invention also provides a third technical solution for one-pot liquefaction process for biomass, comprising the following steps:

preparing a slurry containing a catalyst, a vulcanizing agent and a biomass, and introducing hydrogen into the slurry to carry out a reaction under a pressure of 15-25 MPa and a temperature of 380-480° C., thereby obtaining a bio-oil.

The slurry is prepared with using a vegetable oil residue as the biomass according to the following steps: subjecting the vegetable oil residue sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a straw concentration of 50 wt % to 65 wt %.

The vegetable oil residue in the present invention selected from the group consisting of palm oil residue, soybean oil residue, peanut oil residue, saponin oil residue, linseed oil residue, castor oil residue, rapeseed oil residue, olive oil residue, and any combination thereof.

Said subjecting the vegetable oil residue to compression is carried out under a pressure of 3-5 MPa and a temperature of 40-60° C.

Said subjecting the vegetable oil residue to drying is carried out at a temperature of 80-110° C. for a period of 2-6 h to obtain a dried vegetable oil residue having a moisture content of less than 2 wt %, and after the first pulverization the dried vegetable oil residue has a median particle size of 100-300 μm, and after the second pulverization the dried vegetable oil residue has a median particle size of 30-50 μm and a bulk density of 1500-1600 $kg/m^3$.

The slurry has a viscosity of 300-700 MPa·s (50° C.).

The grinding pulping is stirring pulping, dispersing pulping, emulsifying pulping, shearing pulping, or homogeneous pulping.

The vulcanizing agent can be sulfur, carbon disulfide or dimethyl disulfide.

The oils used in the preparation of the slurry, the types and amounts of the catalyst, the specific method of introducing hydrogen into the slurry, the introduction of cold hydrogen, the amount of catalyst stored in the slurry bed reactor, the reaction time, and the method for preparing biomass charcoal loading with an active component, etc. are the same as those in the technical solution provided in the first aspect.

In a fourth aspect, the present invention also provides a fourth technical solution for one-pot liquefaction process for biomass, comprising: preparing a slurry containing a catalyst, a vulcanizing agent and a biomass, and introducing hydrogen into the slurry to carry out a reaction under a pressure of 15-20 MPa and a temperature of 300-400° C., obtaining a bio-oil.

The slurry is prepared with using straw as the biomass according to the following steps: subjecting the straw sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a straw concentration of 35 to 50 wt %.

Said subjecting the straw to compression is carried out under a pressure of 2-5 MPa and a temperature of 30-60° C.

Said subjecting the straw to drying is carried out at a temperature of 70-110° C. for a period of 3-5 h to obtain a dried straw having a moisture content of less than 2 wt %, and after the first pulverization the dried straw has a median particle size of 100-300 μm, and after the second pulverization the dried straw has a median particle size of 30-50 μm and a bulk density of 400-800 kg/m$^3$.

The slurry has a viscosity of 400-800 mPa·s (50° C.).

The grinding pulping is stirring pulping, dispersing pulping, emulsifying pulping, shearing pulping, or homogeneous pulping.

Said introducing hydrogen into the slurry comprises:

introducing a high-pressure hydrogen into the slurry to prepare a reaction raw material mixture, wherein the high-pressure hydrogen and the slurry have a volume ratio of (600-1500):1; and heating the reaction raw material mixture to 300-400° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.02-0.2 m/s, preferably 0.05-0.08 m/s;

wherein, the high-pressure hydrogen has a pressure of 15-22 MPa, and the cold hydrogen has a temperature of 60-135° C.

Said introducing the high-pressure hydrogen into the slurry comprises two steps of:

firstly, introducing a high-pressure hydrogen into the slurry till the volume ratio of the high-pressure hydrogen to the slurry is (50-200):1, and heating the slurry to 200-280° C., and secondly, introducing a high-pressure hydrogen into the slurry.

The cold hydrogen is injected via 3-5 injection ports which are sequentially formed in a height direction in a side wall of the slurry bed reactor.

The catalyst stored in the slurry bed reactor is controlled in an amount of 5-30 wt % of the mass of liquid phase in the slurry bed reactor; and the reaction is carried out for 30-60 min.

The vulcanizing agent can be sulfur, carbon disulfide or dimethyl disulfide.

The types and amounts of the catalyst, and the method for preparing biomass charcoal loading with an active component, etc. are the same as those in the first technical solution of the present invention.

In a fifth aspect, the present invention also provides a fifth technical solution for one-pot liquefaction process for biomass, comprising the following steps:

preparing a slurry containing a catalyst, a vulcanizing agent and a biomass, and introducing hydrogen into the slurry to carry out a reaction under a pressure of 15-20 MPa and a temperature of 340-420° C., thereby obtaining a bio-oil;

wherein, the slurry is prepared with using a vegetable oil residue as the biomass according to the following steps: subjecting the vegetable oil residue sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a vegetable oil residue concentration of 40 wt % to 50 wt %.

Said subjecting the straw to compression is carried out under a pressure of 0.5-3 MPa and a temperature of 30-50° C.

Said subjecting the vegetable oil residue to drying is carried out at a temperature of 80-110° C. for a period of 2-6 h to obtain a dried straw having a moisture content of less than 2 wt %, and after the first pulverization the dried straw has a median particle size of 50-300 μm, and after the second pulverization the dried straw has a median particle size of 30-50 μm and a bulk density of 1400-1600 kg/m$^3$.

The slurry has a viscosity of 300-650 mPa·s (50° C.).

The grinding pulping is stirring pulping, dispersing pulping, emulsifying pulping, shearing pulping, or homogeneous pulping.

Said introducing hydrogen into the slurry comprises:

introducing a high-pressure hydrogen into the slurry to prepare a reaction raw material mixture, wherein the high-pressure hydrogen and the slurry have a volume ratio of (600-1500):1; and heating the reaction raw material mixture to 340-420° C. and feeding it into a slurry bed reactor to undergo hydrolysis, cracking and hydrogenation reactions, and simultaneously introducing a cold hydrogen into the slurry bed reactor by controlling the slurry bed reactor to have a total, gas velocity of 0.02-0.2 m/s, preferably 0.05-0.08 m/s;

wherein, the high-pressure hydrogen has a pressure of 15-22 MPa, and the cold hydrogen has a temperature of 60-135° C.

Said introducing the high-pressure hydrogen into the slurry comprises two steps of:

firstly, introducing a high-pressure hydrogen into the slurry till the volume ratio of the high-pressure hydrogen to the slurry is (50-200):1, and heating the slurry to 200-280° C., and secondly, introducing a high-pressure hydrogen into the slurry.

The catalyst stored in the slurry bed reactor is controlled in an amount of 5-30 wt % of the mass of liquid phase in the slurry bed reactor; and the reaction is carried out for 30-60 min.

The vulcanizing agent can be sulfur, carbon disulfide or dimethyl disulfide.

The types and amounts of the catalyst, the introduction of cold hydrogen, and the method for preparing biomass charcoal loading with an active component, etc. are the same as those in the first technical solution of the present invention.

In a sixth aspect, the present invention also provides a sixth technical solution for one-pot liquefaction process for biomass, comprising the following steps:

preparing a biomass coal slurry by mixing a biomass powder, a coal powder, a catalyst, and a vulcanizing agent with an oil, and perform grinding pulping, wherein the biomass powder and the coal powder account for 60-70 wt % of the mass of the biomass coal slurry; and wherein the biomass powder is prepared by collecting a biomass and controlling the biomass to have a moisture content of less than 2 wt %, then pulverizing the biomass to a median particle size of 100-300 μm, compressing and molding the pulverized biomass under a pressure of 2-5 MPa and a temperature of 30-60° C., and pulverizing the compressed biomass again to a median particle size of 30-50 μm; and wherein the coal powder is prepared by collecting a coal and controlling the coal to have a moisture content of less than 2 wt %, then pulverizing it to a median particle size of 50-100 μm under a temperature of 30-60° C., compressing and molding the pulverized coal under a pressure of 5-15 MPa, and pulverizing the compressed coal again to a median particle size of 30-50 μm;

carrying out a liquefaction reaction, comprising introducing hydrogen into the biomass coal slurry to carry out a reaction under a pressure of 15 to 25 MPa and a temperature of 380-460° C. to finally obtain a bio-oil;

said preparing a biomass coal slurry comprises: firstly removing dust from the biomass powder and the coal powder, and premixing them with the catalyst and the vulcanizing agent to obtain a premix, and then mixing the premix with the oil; or directly mixing the biomass powder, the coal powder, and the catalyst with the oil.

The biomass accounts for 20-30 wt % of the mass of the biomass coal slurry, and the coal powder accounts for 30-45 wt % of the mass of the biomass coal slurry.

The moisture content is controlled by drying and dehydrating under a temperature of 50-70° C. for a period of 3-5 h.

The compression molding is a briquetting molding, a tabletting molding or a layering molding.

Said preparing a biomass coal slurry comprises controlling the biomass powder to have a bulk density of 300-500 $kg/m^3$, and controlling the coal powder to have a bulk density of 1000-1200 $kg/m^3$.

The pulverization is hammer mill pulverization, ball mill pulverization, rod mill pulverization, ultrafine pulverization or jet pulverization.

The grinding pulping is stirring pulping, dispersing pulping, emulsifying pulping, shearing pulping, homogeneous pulping and colloid grinder pulping.

The grinding pulping lasts for 2-8 min.

The biomass coal slurry has a viscosity of 550-1000 mPa·s (50° C.).

The coal is low rank coal. The oil is selected from the group consisting of hogwash oil, gutter oil, rancid oil, waste lubricating oil, waste engine oil, heavy oil, residual oil, washing oil, anthracene oil, coal tar, petroleum, bio-oil produced by the present process, and any combination thereof.

The catalyst is present in an amount of 1-10 wt %, preferably 1-4 wt %, of the total mass of the biomass and coal; and the catalyst has a particle size of 5-500 μm.

Said introducing hydrogen is carried out by:

injecting high-pressure hydrogen into the slurry till the volume ratio of the high-pressure hydrogen to the slurry is (600-1500):1; thereby obtaining a reaction raw material mixture; and heating the reaction raw material mixture to 320-450° C., feeding the heated reaction raw material mixture into a slurry bed reactor to undergo liquidation, cracking and hydrogenation reactions, and meanwhile, injecting cold hydrogen into the slurry bed reactor, wherein a total gas speed in the slurry bed reactor is controlled within 0.02-0.2 m/s, preferably 0.05-0.08 m/s;

wherein, the high-pressure hydrogen has a pressure of 13-27 MPa, and the cold hydrogen has a temperature of 60-135° C.

Said injecting the high-pressure hydrogen into the slurry comprises two steps of:

injecting the high-pressure hydrogen into the slurry for the first time till the volume ratio of the high-pressure hydrogen to the slurry is (50-200):1, and heating the slurry to 200-350° C., and injecting the high-pressure hydrogen into the slurry for the second time.

The cold hydrogen is injected via 3-5 injection ports which are sequentially formed in a height direction in a side wall of the slurry bed reactor.

The catalyst stored in the slurry bed reactor is controlled in an amount of 5-30 wt % of the mass of liquid in the slurry bed reactor; and the reaction is carried out for 30-90 min.

The biomass can be solid, such as straw of crops such as wheat, rice, corn, cotton, etc., or may be cash crops such as reeds, tabasheer grass, trees, leaves, fruits and vegetables, or algae, industrial wood, paper waste, etc.; the biomass may also be liquid, such as liquid stools; the biomass can be one biomass or a biomass raw material composed of a variety of biomass.

The types and composition of the catalyst, the types of vulcanizing agent, and the method for preparing biomass charcoal loading with a second active component are the same as those in the second technical solution of the present invention.

In a seventh aspect, the present invention also provides a seventh technical solution for one-pot liquefaction process for biomass, comprising the following steps:

preparing a biomass water coal slurry by mixing a biomass powder, a coal powder, a catalyst, and a vulcanizing agent with water, and perform grinding pulping, wherein, the biomass powder and the coal powder account for 55-65 wt % of the mass of the biomass water coal slurry; and wherein the biomass powder is prepared by collecting a biomass and controlling the biomass to have a moisture content of less than 2 wt %, then pulverizing the biomass to a median particle size of 100-300 μm, compressing and molding the pulverized biomass under a pressure of 2-5 MPa and a temperature of 30-60° C., and pulverizing the compressed biomass again to a median particle size of 30-50 μm; and wherein the coal powder is prepared by collecting a coal and controlling the coal to have a moisture content of less than 2 wt %, then pulverizing it to a median particle size of 50-100 μm under a temperature of 30-60° C., compressing and molding the pulverized coal under a pressure of 5-15 MPa, and pulverizing the compressed coal again to a median particle size of 30-100 μm;

carrying out a liquefaction reaction, comprising introducing hydrogen into the biomass water coal slurry to carry out a reaction under a pressure of 15 to 25 MPa and a temperature of 300 to 460° C. to finally obtain a bio-oil;

said preparing a biomass water coal slurry comprises: firstly removing dust from the biomass powder and the coal powder, and premixing them with the catalyst and the vulcanizing agent to obtain a premix, and then mixing the premix with water; or directly mixing the biomass powder, the coal powder, and the catalyst with water.

The biomass accounts for 15-30 wt % of the mass of the biomass water coal slurry, and the coal powder accounts for 35-50 wt % of the mass of the biomass water coal slurry.

The moisture content is controlled by drying and dehydrating under a temperature of 50-70° C. for a period of 3-5 h.

Said preparing a biomass water coal slurry comprises controlling the biomass powder to have a bulk density of 300-500 kg/m$^3$, and controlling the coal powder to have a bulk density of 1200-1300 kg/m$^3$.

The grinding pulping lasts for 2-8 min.

The coal is low rank coal.

In the biomass water coal slurry the catalyst is present in an amount of 1-10 wt %, preferably 1-4 wt %, of the total mass of the biomass and coal; and the catalyst has a particle size of 5-500 μm.

Wherein, the method for introducing hydrogen, the amount of the catalyst stored in the slurry bed reactor, the reaction time, the types and composition of the catalyst, the types of vulcanizing agent, the types of biomass, and the method for preparing biomass charcoal loading with a second active component are all the same as those in the sixth technical solution.

The technical solution of the present invention has the following advantages:

1. In the first one-pot liquefaction process for biomass provided by the present invention, the slurry is prepared with using straw as the biomass according to the following steps: subjecting the straw sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a straw concentration of 30 wt % to 60 wt %. It is the first time to adopt a treatment process of subjecting the straw firstly to compression and then to a second pulverization. Through compression, loose straws undergo collapsing and closing, causing re-displacement and mechanical deformation, which results in reducing of volume of the straw, thereby reducing the porosity of the straw and increasing its density and specific gravity, so that the straws can be easily dispersed in oil, thus increasing its content in the oil and increasing the concentration of the reaction material. The straw is present in the slurry of the present invention in an amount of as high as 30-60 wt %, which is much higher than 5-16 wt % in the existing technology. Meanwhile, the increase of the straw concentration in the slurry will also increase the amount of biomass delivered by the pump per unit time, thereby increasing the efficiency of the entire biomass liquefaction process, reducing industrial costs and energy consumption. In addition, the increase in the specific gravity of the straw is also conducive to the suspension and dispersion of biomass in the slurry, thereby reducing the viscosity of the biomass slurry, achieving smooth flow of the slurry in the pipeline, avoiding clogging of the pipeline, achieving smooth operation and transportation of the pump, and also making it possible to use high viscosity waste oils such as waste engine oil, waste oil, and rancid oil that cannot be used as a biomass liquefied solvent in the prior art.

The second one-pot liquefaction process for biomass provided by the present invention comprises the following steps: preparing a slurry containing a catalyst, a vulcanizing agent and a biomass, and introducing hydrogen into the slurry to carry out a reaction under a pressure of 13-25 MPa and a temperature of 300-500° C., thereby obtaining a bio-oil. According to the process of the present invention, the biomass is subjected to a high-pressure high-temperature hydrolysis reaction in the presence of an appropriate amount of water (namely water inherently contained in the biomass), and the resulted hydrolysis product further undergoes cracking and hydrogenation reactions under the action of hydrogenation and a catalyst, namely amorphous alumina loading oxides of metals of group VIB, group VIIB or group VIII, thereby realizing conversion from the biomass to the bio-oil. In the process provided by the present invention, the conversion ratio of the biomass is up to 90-100%, the yield of the bio-oil is 60-86% or more, and the rate of coke formation is lower than 0.1%.

In the third one-pot liquefaction process for biomass provided by the present invention, the slurry is prepared as follows: subjecting the vegetable oil residue sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a straw concentration of 50 wt % to 65 wt %. It is the first time to adopt a treatment process of subjecting the vegetable oil residue firstly to compression and then to a second pulverization. Through compression, loose vegetable oil residue undergoes collapsing and closing, causing re-displacement and mechanical deformation, which results in reducing of the volume of the vegetable oil residue, thereby reducing the porosity of the vegetable oil residue and increasing its density and specific gravity, making it easy to disperse in the oil and thus increasing its content in the oil, thereby increasing the concentration of the reaction material. The vegetable oil residue is present in the slurry of the present invention in an amount of as high as 50-65 wt %. Meanwhile, the increase of the vegetable oil residue concentration in the slurry will also increase the amount of biomass delivered by the pump per unit time, thereby increasing the efficiency of the entire biomass liquefaction process, reducing industrial costs and energy consumption. In addition, the increase in the specific gravity of the vegetable oil residue is also conducive to the suspension and dispersion of biomass in the slurry, thereby reducing the viscosity of the biomass slurry, achieving smooth flow of the slurry in the pipeline, avoiding clogging of the pipeline, achieving smooth operation and transportation of the pump, and also making it possible to use high viscosity waste oils such as waste engine oil, waste oil, and rancid oil that cannot be used as a biomass liquefied solvent in the prior art.

In the present invention, a slurry containing a catalyst, a vulcanizing agent and a biomass is prepared, and hydrogen is introduced into the slurry to carry out a reaction under a pressure of 15-25 MPa and a temperature of 380-480° C., thereby obtaining a bio-oil. According to the process of the present invention, the biomass undergoes cracking and hydrogenation reactions under the action of hydrogenation and a catalyst, thereby implementing conversion from the biomass to the bio-oil. In the process provided by the present invention, the conversion ratio of the biomass is up to 95-99%.

In the fourth one-pot liquefaction process for biomass provided by the present invention, the slurry is prepared with using straw as the biomass according to the following steps: subjecting the straw sequentially to drying, a first pulverization, compression and a second pulverization to obtain a pretreated biomass, and then mixing the pretreated biomass with the catalyst and the vulcanizing agent to obtain a mixture, and adding the mixture to water to carry out grinding pulping to obtain the slurry having a straw concentration of 35 wt % to 50 wt %. It is the first time to adopt a treatment process of subjecting the straw firstly to compression and then to a second pulverization. Through compression, the loose straw undergoes collapsing and closing, causing re-displacement and mechanical deformation, which results in reducing of the volume of the straw, thereby reducing the porosity of the straw and increasing its density and specific gravity, making it easy to disperse in water and thus increasing its content in water, thereby increasing the concentration of the reaction material. Meanwhile, the increase of the straw concentration in the slurry will also increase the amount of biomass delivered by the pump per unit time, thereby increasing the efficiency of the entire biomass liquefaction process, reducing industrial costs and energy consumption. In addition, the increase in the specific gravity of the straw is also conducive to the suspension and dispersion of biomass in the slurry, thereby reducing the viscosity of the biomass slurry, achieving smooth flow of the slurry in the pipeline, avoiding clogging of the pipeline, achieving smooth operation and transportation of the pump.

In the present invention, a slurry containing a catalyst, a vulcanizing agent and a biomass is prepared, and hydrogen is introduced into the slurry to carry out a reaction under a pressure of 15-20 MPa and a temperature of 300-400° C., thereby obtaining a bio-oil. According to the process of the present invention, the biomass undergoes cracking and hydrogenation reactions under the action of hydrogenation and a catalyst, thereby implementing conversion from the biomass to the bio-oil, and improving the yield of the bio-oil. In the process provided by the present invention, the conversion ratio of the biomass is up to 95-99%, the yield of the bio-oil is 60-80%, and the residue in the bio-oil is less than 0.1 wt %.

In the fifth one-pot liquefaction process for biomass provided by the present invention, the slurry is prepared as follows: subjecting the vegetable oil residue sequentially to drying, a first pulverization, compression and a second pulverization to obtain a pretreated biomass, and then mixing the pretreated biomass with the catalyst and the vulcanizing agent to obtain a mixture, and adding the mixture to water to carry out grinding pulping to obtain the slurry having a straw concentration of 40 wt % to 50 wt %. It is the first time in the present invention to adopt a treatment process of subjecting the vegetable oil residue firstly to compression and then to a second pulverization. Through compression, the loose vegetable oil residue undergoes collapsing and closing, causing re-displacement and mechanical deformation, which results in reducing of volume of the vegetable oil residue, thereby reducing the porosity of the vegetable oil residue and increasing its density and specific gravity, making it easy to disperse in the water and thus increasing its content in water, thereby increasing the concentration of the reaction material. Meanwhile, the increase of the vegetable oil residue concentration in the slurry will also increase the amount of biomass delivered by the pump per unit time, thereby increasing the efficiency of the entire biomass liquefaction process, reducing industrial costs and energy consumption. In addition, the increase in the specific gravity of the vegetable oil residue is also conducive to the suspension and dispersion of biomass in the slurry, thereby reducing the viscosity of the biomass slurry, achieving smooth flow of the slurry in the pipeline, avoiding clogging of the pipeline, achieving smooth operation and transportation of the pump.

In the present invention, the slurry containing a catalyst, a vulcanizing agent and a biomass is prepared, and hydrogen is introduced into the slurry to carry out a reaction under a pressure of 15-20 MPa and a temperature of 340-420° C. According to the process of the present invention, the biomass undergoes cracking and hydrogenation reactions under the action of hydrogenation and a catalyst, thereby implementing conversion from the biomass to the bio-oil. In the process provided by the present invention, the conversion ratio of the biomass is up to 95-99%, the yield of the bio-oil is 70-86%, and the residue in the bio-oil is less than 0.1 wt %.

In the seventh one-pot liquefaction process for biomass provided by the present invention, it is the first time to realize co-liquefaction of coal and biomass with water as a hydrogen-donor solvent. The present invention successfully prepares a biomass coal water slurry having a biomass and coal content of 55-65 wt %, and a viscosity of only 450-1100 mPa·s (50° C.) by a process of subjecting the biomass and coal to dehydrating, pulverizing, compressing, re-pulverizing, a first pulping, and grinding, and by optimizing the pulverized particle size and compression conditions.

2. In the first one-pot liquefaction process provided by the present invention, the compression temperature is controlled at 30-60° C. Compressing the straw at this temperature can significantly enhance the rheological properties of the straw and reduce the viscosity of the biomass slurry. The slurry formed by straw and oil in the process of the present invention has a viscosity of 500-1400 mPa·s (50° C.), thereby achieving smooth flow of the slurry in the pipeline, avoiding clogging of the pipeline, achieving smooth operation and transportation of the pump.

In the third one-pot liquefaction process provided by the present invention, the compression temperature is controlled at 40-60° C. Compressing the vegetable oil residue at this temperature can significantly enhance the rheological properties of the vegetable oil residue and reduce the viscosity of the biomass slurry. The slurry formed by the vegetable oil residue and oil in the process of the present invention has a viscosity of 300-700 mPa·s (50° C.), thereby achieving smooth flow of the slurry in the pipeline, avoiding clogging of the pipeline, achieving smooth operation and transportation of the pump.

In the fourth one-pot liquefaction process provided by the present invention, the compression temperature is controlled at 30-60° C. Compressing the straw at this temperature can significantly enhance the rheological properties of the straw and reduce the viscosity of the biomass slurry. The slurry formed by straw and oil in the process of the present invention has a viscosity of 400-800 mPa·s (50° C.), thereby achieving smooth flow of the slurry in the pipeline, avoiding clogging of the pipeline, achieving smooth operation and transportation of the pump.

In the fifth one-pot liquefaction process provided by the present invention, the compression temperature is controlled at 30-50° C. Compressing the vegetable oil residue at this temperature can significantly enhance the rheological properties of the vegetable oil residue and reduce the viscosity of the biomass slurry. The slurry formed by the vegetable oil residue and oil in the process of the present invention has a viscosity of 300-650 mPa·s (50° C.), thereby achieving smooth flow of the slurry in the pipeline, avoiding clogging of the pipeline, achieving smooth operation and transportation of the pump.

In the sixth technical solution of the present invention, it is the first time to realize co-liquefaction of coal, biomass and oil. The present invention successfully prepares a biomass coal slurry having a biomass and coal content of 60-70 wt %, and a viscosity of only 550-1000 mPa·s (50° C.) by a process of subjecting the biomass and coal to dehydrating, pulverizing, compressing, re-pulverizing, a first pulping, and grinding, and by optimizing the pulverized particle size and compression conditions.

In the seventh one-pot liquefaction process for biomass provided by the present invention, it is the first time to realize co-liquefaction of coal and biomass with water as a hydrogen-donor solvent. The present invention successfully prepares a biomass coal water slurry having a biomass and coal content of 55-65 wt %, and a viscosity of only 450-1100 mPa·s (50° C.) by a process of subjecting the biomass and coal to dehydrating, pulverizing, compressing, re-pulverizing, a first pulping, and grinding, and by optimizing the pulverized particle size and compression conditions.

In the one-pot liquefaction process for biomass provided by the present invention, compression can cause the pore structure inside the coal and biomass material to collapse and close, resulting in plastic flow and plastic deformation, thereby greatly increasing the density of the coal and biomass raw materials, so that they can be well dispersed in the solvent oil. Meanwhile, the collapse and closure of the pore structure prevents the coal and biomass from absorbing the solvent oil, so that the solvent oil can fully play its role as a dispersant. The inventors have found that the compression temperature has a great influence on the degree of plastic rheology and plastic deformation. The higher the temperature is, the greater the density becomes. However, excessive temperature will cause the material to decompose or cause other problems. Therefore, a temperature of 30° C. to 60° C. is adopted for the compression. The re-pulverization operation after compression increases the contactable area of the raw material, so that the raw material can be in better contact with the catalyst and the solvent oil, thus enhancing the transfer of hydrogen, greatly reducing situations that the raw material cannot contact with hydrogen and catalyst due to being in a porous structure.

The process of "a first pulverization+compression+a second pulverization" provided by the present invention can be applied to all coal materials and biomass materials having pore structure, especially low-rank coal materials such as lignite, and porous biomass materials such as straw and rice husk. The resulting high-concentration biomass coal slurry has good slurryability and high fluidity, and can be directly transported smoothly by the pump, which not only effectively improve the operation stability of the delivery system, the utilization efficiency of the liquefaction device and the liquefaction efficiency, satisfying the feeding requirements of the subsequent treatment process, but also realizes clean and efficient use of inferior coal and biomass. The close proximity between the coal and the biomass enables the hydrogen produced by biomass pyrolysis to be used as part of hydrogen source for coal pyrolysis, reducing the hydrogen consumption. Through the co-liquefaction process provided by the present invention, high-viscosity waste oils, such as waste engine oil, gutter oil and rancidity oil, which cannot be used as the liquefaction solvent of the coal and the biomass in the existing technology, can also be utilized.

In the sixth technical solution provided by the present invention, bio-oil is obtained by introducing hydrogen into the slurry to carry out a reaction under a pressure of 13-25 MPa and a temperature of 300-500° C. The process of the present invention enables the coal and the biomass to undergo liquefaction at high-pressure and high-temperature, and the liquefaction product further undergoes cracking and hydrogenation reactions under the action of hydrogenation and a catalyst, namely amorphous alumina loading oxides of metals of group VIB, group VIIB or group VIII, thereby implementing conversion from the biomass to the bio-oil. In the process provided by the present invention, the conversion ratio of the biomass is up to 90-99%, the yield of the bio-oil is 60-80% or more, and amount of residue is no higher than 2.5 wt %.

In the seventh technical solution provided by the present invention, a bio-oil is obtained by introducing hydrogen into the slurry to carry out a reaction under a pressure of 15-25 MPa and a temperature of 300-460° C. According to the process of the present invention, the biomass is subjected to a high-pressure high-temperature hydrolysis reaction in the presence of an appropriate amount of water (namely water inherently contained in the biomass and coal), and the hydrolysis product further undergoes cracking and hydrogenation reactions under the action of hydrogenation and a catalyst, namely amorphous alumina loading oxides of metals of group VIB, group VIIB or group VIII, thereby implementing conversion from the biomass to the bio-oil. In the process provided by the present invention, the conversion ratio of the coal and the biomass is up to 90-95%, the yield of the bio-oil is 70-85% or more, and the rate of coke formation is lower than 5%.

The present invention can ensure the solid particles used for preparing the biomass oil coal slurry have uniform particle size by further cooperating with the screening process of the solid material, so that the obtained biomass coal slurry has better stability, and is difficult to settle during transportation, avoiding blockage of the transportation pipeline and damage to the liquefaction equipment.

In the present invention, the catalyst is preferably an amorphous alumina loading oxides of metals of group VIB, group VIIB or group VIII, or a composite catalyst of biomass charcoal and amorphous iron oxide. These catalysts have better hydrogenation performance after vulcanization with noble metal, and can prevent coke forming. The biomass charcoal or the amorphous alumina has acidity and cracking function, and the amorphous iron oxide has alkalinity, can facilitate liquefaction, and also has catalytic hydrogenation function after iron is vulcanized, thereby reducing consumption of the noble metal.

In the one-pot liquefaction process for coal and biomass provided by the present invention, coal and biomass are firstly subjected to pretreatment, such as drying, compression, crushing, dust-removing, etc., then mixed with the catalyst. In this way, the surface of coal and biomass powder can be greatly utilized and help the catalyst to attach to the surface of the solid powder, so that the catalyst can timely provide hydrogen transfer for the coal and biomass liquefaction product; therefore, ensuring no coke polycondensation occurs in the whole procedure of the one-pot liquefaction process, and a purpose of reducing residue is achieved.

3. In the one-pot liquefaction process for coal and biomass provided by the present invention, the catalyst is preferably selected form the group consisting of amorphous iron oxyhydroxide, amorphous alumina loading with an active component, biomass charcoal loading an active component and any combination thereof, wherein the active component is selected form the group consisting of oxides of metals of group VIB, group VIIB, group VIII and any combination thereof in the periodic table of elements. Amorphous FeOOH is alkaline and can promote the hydrolysis. Biomass charcoal and amorphous alumina are inherently acidic, and have a function of pyrolysis, which can be enhanced when loading active components, thus avoiding the generation of coke in the process of biomass liquefaction.

4. In the one-pot liquefaction process for coal and biomass provided by the present invention, slurry bed reactor is adopted, into which the reaction raw material mixture is fed via the bottom thereof to carry out reaction. Meanwhile, cold hydrogen is injected into the reactor, so that flow rate difference control of each phase state is implemented in the reactor depending on different specific weights of gas, liquid and solid materials and by matching with specific weight difference variation caused by the yield of a reacted light oil product. The biomass raw material mixture undergoes hydrolysis, cracking and hydrogenation reactions in the reactor from bottom to top; in such procedures, even though the biomass with a large specific weight and the catalyst solid particles with a large specific weight ascend along with the gas and the light oil product, the ascended biomass and catalyst solid particles return to the bottom of the reactor under the action of the upper-part cold hydrogen to undergo the reactions again, and the content of the hydrogen in the slurry and the injection amount of the cold hydrogen in the reactor are suitably adjusted according to the densities of materials in the upper part, middle part and lower part of the reactor, thereby implementing circulation of an unconverted biomass in the reactor and balance discharge of the catalyst; therefore, the reactions of hydrolysis, cracking, hydrogenation and the like are guaranteed to be carried out completely, which facilitates improvement on the conversion ratio of the biomass and the yield of an oil phase.

5. In the one-pot liquefaction process for coal and biomass provided by the present invention, the high-pressure hydrogen is injected into the slurry in the two steps, that is, the high-pressure hydrogen is injected once before and after the slurry is heated, respectively, and the former injection of the high-pressure hydrogen can improve perturbation of the slurry in a heat exchanger, thereby avoiding deposition of the solid biomass and the catalyst.

6. In the one-pot liquefaction process for coal and biomass provided by the present invention, the catalyst is preferably an amorphous alumina loading oxides of metals of group VIB, group VIIB or group VIII, or a composite catalyst of biomass charcoal and amorphous iron oxide. These catalysts have better hydrogenation performance after vulcanized with noble metal and can prevent coke forming. The biomass charcoal or amorphous alumina have acidity and cracking function, and the amorphous iron oxide has alkalinity, can facilitate biomass hydrolysis, and also has catalytic hydrogenation function after iron is vulcanized, thereby reducing consumption of the noble metal.

7. In the one-pot liquefaction process for coal and biomass provided by the present invention, when the biomass raw material is solid, the solid biomass needs to be pretreated firstly, such as by drying, crushing, dust-removing, etc., to obtain a pretreated solid biomass, and then the pretreated solid biomass is mixed with the catalyst so as to greatly utilize the surface of biomass powder and help the catalyst to attach to the surface of the solid biomass powder, so that the catalyst can timely provide hydrogen transfer for the biomass hydrolysis product; therefore, it is ensured that no coke polycondensation occurs in the whole procedure of the one-pot liquefaction process for biomass, and a purpose of reducing the rate of coke formation is achieved.

DETAILED DESCRIPTION OF EMBODIMENTS

The technical solution of the present invention is described below clearly and completely. Apparently, the embodiments described below are a part, but not all, of the embodiments of the present invention. All other embodiments, obtained by those of ordinary skill in the art based on the embodiments of the present invention without any creative efforts, fall into the protection scope of the present invention. In addition, technical features involved in various implementations of the present invention described below can be combined with each other as long as they do not conflict with each other.

Embodiment 1

Provided is one-pot liquefaction process for biomass described as below.

Pretreatment of Biomass:

Wheat straw and corn straw are fed into a drier for drying under a temperature of 50° C. for 5 h to have a moisture content of less than 2 wt %, and then fed to an ultrafine pulverizer for a first pulverization to a median particle size of 100 μm, then fed into a plodder for compressing at a temperature of 30° C. and a pressure of 3 MPa, and then extruded and molded, and then subjected to a second pulverization to produce a pretreated biomass having a median particle size of 30 μm and a bulk density of 500 kg/m$^3$.

Preparation of Catalyst:

S1, carrying out acidification on biomass charcoal to produce a biomass charcoal support; and S2, subjecting Mo oxide and the above biomass charcoal support to vibration grinding to obtain a biomass charcoal loading Mo oxide having a particle size of 400-500 μm, i.e. a catalyst.

In the above catalyst, Mo accounts for 1% by weight of the above biomass charcoal support. The acidification is carried out with an acid medium which has $H^+$ concentration of 5 mol/L. A volume ratio of the carbonized biomass charcoal to the acid medium is 1:5, and the acidification is carried out at a temperature of 80° C. for a period of 1 h.

Preparation of Biomass Slurry:

The pretreated biomass and the above catalyst are mixed with sulfur to obtain a mixture, and the mixture is added to a mixed oil of hogwash oil and residual oil to carry out stirring grinding to form a slurry. The wheat straw and corn straw are present in a total amount of 60 wt % in the slurry, and the slurry has a viscosity of 500 mPa·s (50° C.). Further, in the slurry, the catalyst accounts for 1 wt %, and the vulcanizing agent accounts for 0.4 wt % of the pretreated biomass.

Liquefaction:

Introducing hydrogen into the slurry to carry out a reaction under a pressure of 25 MPa and a temperature of 380° C. to obtain a bio-oil.

Said introducing hydrogen into the slurry comprises: introducing a high-pressure hydrogen into the slurry to prepare a reaction raw material mixture, wherein the high-pressure hydrogen and the slurry have a volume ratio of 1500:1; and heating the reaction raw material mixture to 380° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.2 m/s; wherein, the high-pressure hydrogen has a pressure of 27 MPa, and the cold hydrogen has a temperature of 135° C.

The cold hydrogen is injected via 3 injection ports which are sequentially formed in a height direction in a side wall of the slurry bed reactor. The biomass charcoal loading Mo oxide as a catalyst is stored in the slurry bed reactor in an amount of 30 wt % of the mass of liquid in the slurry bed reactor; and the reaction is carried out for a period of 30 min.

Embodiment 2

Provided is one-pot liquefaction process for biomass described as below.

Pretreatment of Biomass:

Palm oil residue is fed into a drier for drying under a temperature of 80° C. for 5 h to have a moisture content of less than 2 wt %, and then fed to an ultrafine pulverizer for a first pulverization to a median particle size of 100 μm, then fed into a briquetting press for compressing at a temperature of 50° C. and a pressure of 5 MPa, and then extruded and molded, and then subjected to a second pulverization to produce a pretreated biomass having a median particle size of 30 μm and a bulk density of 1600 kg/m$^3$.

Preparation of Catalyst:

S1, carrying out acidification on biomass charcoal to produce a biomass charcoal support; and.

S2, subjecting Mo oxide and the above biomass charcoal support to vibration grinding to obtain a biomass charcoal loading Mo oxide having a particle size of 400-500 μm, i.e. a catalyst.

In the above catalyst, Mo accounts for 1% by weight of the above biomass charcoal support. The acidification is carried out with an acid medium which has a $H^+$ concentration of 5 mol/L. A volume ratio of the carbonized biomass charcoal to the acid medium is 1:5, and the acidification is carried out at a temperature of 80° C. for a period of 1 h.

Preparation of Biomass Slurry:

The pretreated biomass and the above catalyst are mixed with sulfur to obtain a mixture, and the mixture is added to a mixed oil of hogwash oil and residual oil to carry out stirring grinding to form a slurry. The palm oil residue is present in a total amount of 60 wt % in the slurry, and the slurry has a viscosity of 300 mPa·s (50° C.). Further, in the slurry, the catalyst accounts for 1 wt %, and the vulcanizing agent accounts for 0.4 wt % of the pretreated biomass.

Liquefaction:

Introducing hydrogen into the slurry to carry out a reaction under a pressure of 25 MPa and a temperature of 380° C. to obtain a bio-oil.

Said introducing hydrogen into the slurry comprises: introducing a high-pressure hydrogen into the slurry to prepare a reaction raw material mixture, wherein the high-pressure hydrogen and the slurry have a volume ratio of 1500:1; and heating the reaction raw material mixture to 380° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.2 m/s; wherein, the high-pressure hydrogen has a pressure of 27 MPa, and the cold hydrogen has a temperature of 135° C.

The cold hydrogen is injected via 3 injection ports which are sequentially formed in a height direction in a side wall of the slurry bed reactor. The biomass charcoal loading Mo oxide as a catalyst is stored in the slurry bed reactor in an amount of 30 wt % of the mass of liquid in the slurry bed reactor; and the reaction is carried out for a period of 100 min.

Embodiment 3

Provided is one-pot liquefaction process for biomass described as below.

Pretreatment of Biomass:

Cotton straw is fed into a drier for drying under a temperature of 60° C. for 4 h to have a moisture content of less than 2 wt %, and then fed to an ultrafine pulverizer for a first pulverization to a median particle size of 210 μm, then fed into a briquetting press for compressing at a temperature of 55° C. and a pressure of 2.1 MPa, and then extruded and molded, and then subjected to a second pulverization to produce a pretreated biomass having a median particle size of 40 μm and a bulk density of 440 kg/m$^3$.

Preparation of Biomass Charcoal Loading Mo Oxide and Pd Oxide:

S1, carrying out acidification on biomass charcoal to produce a biomass charcoal support; and S2, subjecting Mo oxide, Pd oxide and the above biomass charcoal support to vibration grinding to obtain a biomass charcoal loading Mo oxide and Pd oxide, having a particle size of 120-400 μm.

In the above biomass charcoal loading Mo oxide and Pd oxide, Mo and Pd account for 3.5% by weight of the above biomass charcoal support. The acidification is carried out with an acid medium which has a $H^+$ concentration of 3.5 mol/L. A volume ratio of the carbonized biomass charcoal to the acid medium is 1:10, and the acidification is carried out at a temperature of 50° C. for a period of 4.3 h.

Preparation of Biomass Slurry:

The pretreated biomass and the above biomass charcoal loading Mo oxide and Pd oxide are mixed with amorphous FeOOH and sulfur to obtain a mixture, and the mixture is added to a mixed oil of heavy oil and wash oil to carry out emulsifying pulping to form a slurry. The cotton straw are present in a total amount of 30 wt % in the slurry, and the slurry has a viscosity of 725 mPa·s (50° C.). Further, in the slurry, the biomass charcoal loading Mo oxide and Pd oxide and amorphous FeOOH (having a particle size of 150-200 μm) account for 6 wt %, and the vulcanizing agent accounts for 0.2 wt % of the pretreated biomass.

Liquefaction:

Introducing hydrogen into the slurry to carry out a reaction under a pressure of 20 MPa and a temperature of 400° C. to obtain a bio-oil.

Said introducing hydrogen into the slurry comprises: introducing a high-pressure hydrogen into the slurry to prepare a reaction raw material mixture, wherein the high-pressure hydrogen and the slurry have a volume ratio of 1000:1; and heating the reaction raw material mixture to 400° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.10 m/s; wherein, the high-pressure hydrogen has a pressure of 21 MPa, and the cold hydrogen has a temperature of 80° C.

The cold hydrogen is injected via 4 injection ports which are sequentially formed in a height direction in a side wall of the slurry bed reactor. The biomass charcoal loading Mo oxide and Pd oxide as a catalyst is stored in the slurry bed reactor in an amount of 25 wt % of the mass of liquid in the slurry bed reactor; and the reaction is carried out for a period of 50 min.

Embodiment 4

Provided is one-pot liquefaction process for biomass described as below.

Pretreatment of Biomass:

Wheat straw and flax straw are fed into a drier for drying under a temperature of 65° C. for 4.5 h to have a moisture content of less than 2 wt %, and then fed to an ultrafine pulverizer for a first pulverization to a median particle size of 180 μm, then fed into a briquetting press for compressing at a temperature of 45° C. and a pressure of 2.6 MPa, and then extruded and molded, and then subjected to a second pulverization to produce a pretreated biomass having a median particle size of 36 μm and a bulk density of 440 kg/m$^3$.

Preparation of Biomass Slurry:

The pretreated biomass is mixed with amorphous FeOOH (having a particle size of 100-200 μm) and dimethyl disulfide to obtain a mixture, and the mixture is added to sour oil to carry out shearing pulping to form a slurry. The wheat straw and flax straw are present in a total amount of 55 wt % in the slurry, and the slurry has a viscosity of 620 mPa·s (50° C.). Further, in the slurry, amorphous FeOOH accounts for 6 wt % and the vulcanizing agent accounts for 0.25 wt % of the mass of the pretreated biomass.

Liquefaction:

Introducing hydrogen into the slurry to carry out a reaction under a pressure of 17 MPa and a temperature of 440° C. to obtain a bio-oil.

Said introducing the high-pressure hydrogen into the slurry comprises two steps of: firstly, introducing a high-pressure hydrogen into the slurry till the volume ratio of the high-pressure hydrogen to the slurry is 50:1, and heating the slurry to 200° C., and secondly, introducing a high-pressure hydrogen into the slurry, wherein the total volume of the high-pressure hydrogen introduced twice and the slurry have a volume ratio of 1300:1; and heating the reaction raw material mixture to 440° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.05 m/s; wherein, the high-pressure hydrogen has a pressure of 16 MPa, and the cold hydrogen has a temperature of 105° C.

The cold hydrogen is injected via 4 injection ports which are sequentially formed in a height direction in a side wall of the slurry bed reactor. The amorphous FeOOH used as a catalyst is stored in the slurry bed reactor in an amount of 9 wt % of the mass of liquid in the slurry bed reactor; and the reaction is carried out for a period of 110 min.

Embodiment 5

Provided is one-pot liquefaction process for biomass described as below.

Pretreatment of Biomass:

Olive oil residue is fed into a drier for drying under a temperature of 90° C. for 3 h to have a moisture content of less than 2 wt %, and then fed to an ultrafine pulverizer for a first pulverization to a median particle size of 180 μm, then fed into a briquetting press for compressing at a temperature of 60° C. and a pressure of 3.5 MPa, and then extruded and molded, and then subjected to a second pulverization to produce a pretreated biomass having a median particle size of 36 μm and a bulk density of 1522 kg/m$^3$.

Preparation of Biomass Slurry:

The pretreated biomass is mixed with amorphous FeOOH (having a particle size of 100-200 μm) and dimethyl disulfide to obtain a mixture, and the mixture is added to sour oil to carry out shearing pulping to form a slurry. The olive oil residue is present in a total amount of 55 wt % in the slurry, and the slurry has a viscosity of 617 mPa·s (50° C.). Further, in the slurry, amorphous. FeOOH accounts for 6 wt % and the vulcanizing agent accounts for 0.25 wt % of the mass of the pretreated biomass.

Liquefaction:

Introducing hydrogen into the slurry to carry out a reaction under a pressure of 17 MPa and a temperature of 440° C. to obtain a bio-oil.

Said introducing the high-pressure hydrogen into the slurry comprises two steps of: firstly, introducing a high-pressure hydrogen into the slurry till the volume ratio of the high-pressure hydrogen to the slurry is 50:1, and heating the slurry to 200° C., and secondly, introducing a high-pressure hydrogen into the slurry, wherein the total volume of the high-pressure hydrogen introduced twice and the slurry have a volume ratio of 1300:1; and heating the reaction raw material mixture to 440° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.05 m/s; wherein, the high-pressure hydrogen has a pressure of 16 MPa, and the cold hydrogen has a temperature of 105° C.

The cold hydrogen is injected via 4 injection ports which are sequentially formed in a height direction in a side wall of the slurry bed reactor. The amorphous FeOOH used as a catalyst is stored in the slurry bed reactor in an amount of 9 wt % of the mass of liquid in the slurry bed reactor; and the reaction is carried out for a period of 110 min.

Embodiment 6

Provided is one-pot liquefaction process for biomass described as below.

Pretreatment of Biomass:

Rapeseed oil residue is fed into a drier for drying under a temperature of 80° C. for 2 h to have a moisture content of less than 2 wt %, and then fed to an ultrafine pulverizer for a first pulverization to a median particle size of 200 μm, then fed into a briquetting press for compressing at a temperature of 40° C. and a pressure of 3 MPa, and then extruded and molded, and then subjected to a second pulverization to produce a pretreated biomass having a median particle size of 45 μm and a bulk density of 1600 kg/m$^3$.

Preparation of Catalyst:

S1, carrying out alkalization on biomass charcoal to produce a biomass charcoal support; and S2, subjecting Ni oxide and the above biomass charcoal support to flat grinding and ball-milling to obtain a biomass charcoal loading Ni oxide having a particle size of 200-400 μm, i.e. a catalyst.

In the above catalyst, Ni accounts for 1% by weight of the above biomass charcoal support. The alkalization is carried out with an acid medium which has an $OH^+$ concentration of 0.5 mol/L. A volume ratio of the carbonized biomass charcoal to the alkaline medium is 1:15, and the alkalization is carried out at a temperature of 30° C. for a period of 10 h.

Preparation of Biomass Slurry:

The pretreated biomass and the above catalyst are mixed with carbon disulfide to obtain a mixture, and the mixture is added to sour oil to carry out shearing pulping to form a slurry. The Rapeseed oil residue is present in a total amount of 59 wt % in the slurry, and the slurry has a viscosity of 305 mPa·s (50° C.). Further, in the slurry, the catalyst accounts for 1 wt % and the vulcanizing agent accounts for 0.25 wt % of the mass of the pretreated biomass.

Liquefaction:

Introducing hydrogen into the slurry to carry out a reaction under a pressure of 15 MPa and a temperature of 380° C. to obtain a bio-oil.

Said introducing hydrogen into the slurry comprises: introducing a high-pressure hydrogen into the slurry to prepare a reaction raw material mixture, wherein the high-pressure hydrogen and the slurry have a volume ratio of 600:1; and heating the reaction raw material mixture to 380° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.2 m/s; wherein, the high-pressure hydrogen has a pressure of 18 MPa, and the cold hydrogen has a temperature of 135° C.

The cold hydrogen is injected via 5 injection ports which are sequentially formed in a height direction in a side wall of the slurry bed reactor. The biomass charcoal loading Ni oxide as a catalyst is stored in the slurry bed reactor in an amount of 30 wt % of the mass of liquid in the slurry bed reactor; and the reaction is carried out for a period of 90 min.

Embodiment 7

Provided is one-pot liquefaction process for biomass described as below.

Pretreatment of Biomass:

Rice straw and reed straw are fed into a drier for drying under a temperature of 70° C. for 5 h to have a moisture content of less than 2 wt %, and then fed to an ultrafine pulverizer for a first pulverization to a median particle size of 100 μm, then fed into a briquetting press for compressing at a temperature of 60° C. and a pressure of 2 MPa, and then extruded and molded, and then subjected to a second pulverization to produce a pretreated biomass having a median particle size of 30 μm and a bulk density of 400 kg/m$^3$.

Preparation of Catalyst:

S1, carrying out acidification on biomass charcoal to produce a biomass charcoal support; and.

S2, subjecting Mo oxide and the above biomass charcoal support to vibration grinding to obtain a biomass charcoal loading Mo oxide having a particle size of 400-500 m, i.e. a catalyst.

In the above catalyst, Mo accounts for 1% of the mass of the above biomass charcoal support. The acidification is carried out with an acid medium which has a $H^+$ concentration of 5 mol/L. A volume ratio of the carbonized biomass charcoal to the acid medium is 1:5, and the acidification is carried out at a temperature of 80° C. for a period of 1 h.

Preparation of Biomass Slurry:

The pretreated biomass and the above catalyst are mixed with sulfur to obtain a mixture, and the mixture is added to water to carry out stirring grinding to form a slurry. The rice straw and reed straw are present in a total amount of 50 wt % in the slurry, and the slurry has a viscosity of 800 mPa·s (50° C.). Further, in the slurry, the catalyst accounts for 1 wt % and the vulcanizing agent accounts for 0.4 wt % of the mass of the pretreated biomass.

Liquefaction:

Introducing hydrogen into the slurry to carry out a reaction under a pressure of 20 MPa and a temperature of 300° C. to obtain a bio-oil.

Said introducing hydrogen into the slurry comprises: introducing a high-pressure hydrogen into the slurry to prepare a reaction raw material mixture, wherein the high-pressure hydrogen and the slurry have a volume ratio of 1500:1; and heating the reaction raw material mixture to 320° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.2 m/s; wherein, the high-pressure hydrogen has a pressure of 22 MPa, and the cold hydrogen has a temperature of 135° C.

The cold hydrogen is injected via 3 injection ports which are sequentially formed in a height direction in a side wall of the slurry bed reactor. The biomass charcoal loading Mo oxide as a catalyst is stored in the slurry bed reactor in an amount of 30 wt % of the mass of liquid in the slurry bed reactor; and the reaction is carried out for a period of 30 min.

Embodiment 8

Provided is one-pot liquefaction process for biomass described as below.

Pretreatment of Biomass:

Olive oil residue is fed into a drier for drying under a temperature of 100° C. for 4.0 h to have a moisture content of less than 2 wt %, and then fed to an ultrafine pulverizer for a first pulverization to a median particle size of 290 μm, then fed into a briquetting press for compressing at a temperature of 35° C. and a pressure of 2.7 MPa, and then extruded and molded, and then subjected to a second pulverization to produce a pretreated biomass having a median particle size of 44 μm and a bulk density of 1510 kg/m$^3$.

Preparation of Biomass Slurry:

The pretreated biomass is mixed with amorphous FeOOH (having a particle size of 100-200 μm) and sulfur to obtain a mixture, and the mixture is added to water to carry out shearing grinding to form a slurry. The olive oil residue is present in a total amount of 50 wt % in the slurry, and the slurry has a viscosity of 465 mPa·s (50° C.). Further, in the slurry, amorphous FeOOH accounts for 6 wt % and the vulcanizing agent accounts for 0.25 wt % of the mass of the pretreated biomass.

Liquefaction:

Introducing hydrogen into the slurry to carry out a reaction under a pressure of 18 MPa and a temperature of 340° C. to obtain a bio-oil.

Said introducing the high-pressure hydrogen into the slurry comprises two steps of: firstly, introducing a high-pressure hydrogen into the slurry till the volume ratio of the high-pressure hydrogen to the slurry is 50:1, and heating the slurry to 200° C., and secondly, introducing a high-pressure hydrogen into the slurry, wherein the total volume of the high-pressure hydrogen introduced twice and the slurry have a volume ratio of 1300:1; and heating the reaction raw material mixture to 340° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.05 m/s; wherein, the high-pressure hydrogen has a pressure of 20 MPa, and the cold hydrogen has a temperature of 105° C.

The cold hydrogen is injected via 4 injection ports which are sequentially formed in a height direction in a side wall of the slurry bed reactor. The amorphous FeOOH used as a catalyst is stored in the slurry bed reactor in an amount of 9 wt % of the mass of liquid in the slurry bed reactor; and the reaction is carried out for a period of 40 min.

Embodiment 9

Provided is one-pot liquefaction process for biomass described as below.

Pretreatment of Biomass:

Soybean oil residue is fed into a drier for drying under a temperature of 95° C. for 3.5 h to have a moisture content of less than 2 wt %, and then fed to an ultrafine pulverizer for initial pulverization to a median particle size of 110 μm, then fed into a briquetting press for compressing at a temperature of 38° C. and a pressure of 2.5 MPa, and then extruded and molded, and then subjected to a second pulverization to produce a pretreated biomass having a median particle size of 50 μm and a bulk density of 1500 kg/m$^3$.

Preparation of Biomass Slurry:

The pretreated biomass is mixed with amorphous alumina (having a particle size of 200-500 μm) loading Mn oxide and Pd oxide, amorphous FeOOH and sulfur to obtain a mixture, and the mixture is added to water to carry out stirring grinding to form a slurry. The soybean oil residue is present in a total amount of 42 wt % in the slurry, and the slurry has a viscosity of 481 mPa·s (50° C.). Further, in the slurry, the total mass of amorphous alumina loading Mn oxide and Pd oxide and amorphous FeOOH accounts for 3 wt % and the vulcanizing agent accounts for 0.4 wt % of the mass of the pretreated biomass.

Liquefaction:

Introducing hydrogen into the slurry to carry out a reaction under a pressure of 20 MPa and a temperature of 420° C. to obtain a bio-oil.

Said introducing the high-pressure hydrogen into the slurry comprises two steps of: firstly, introducing a high-pressure hydrogen into the slurry till the volume ratio of the high-pressure hydrogen to the slurry is 100:1, and heating the slurry to 250° C., and secondly, introducing a high-pressure hydrogen into the slurry, wherein the total volume of the high-pressure hydrogen introduced twice and the slurry have a volume ratio of 1050:1; and heating the reaction raw material mixture to 420° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.07 m/s; wherein, the high-pressure hydrogen has a pressure of 21 MPa, and the cold hydrogen has a temperature of 105° C.

The cold hydrogen is injected via 3 injection ports which are sequentially formed in a height direction in a side wall of the slurry bed reactor. The amorphous FeOOH as a catalyst is stored in the slurry bed reactor in an amount of 27 wt % of the mass of liquid in the slurry bed reactor; and the reaction is carried out for a period of 35 min.

Embodiment 10

Provided is one-pot liquefaction process for biomass described as below.

Pretreatment of Biomass:

Wheat straw is fed into a drier for drying under a temperature of 50° C. for 5 h to have a moisture content of less than 2 wt %, and then fed to an ultrafine pulverizer for initial pulverization to a median particle size of 100 μm, then fed into a briquetting press for compressing at a temperature of 30° C. and a pressure of 3 MPa, and then extruded and molded, and then subjected to a second pulverization to produce a pretreated biomass having a median particle size of 30 μm and a bulk density of 500 kg/m$^3$.

Preparation of Catalyst:

S1, carrying out acidification on biomass charcoal to produce a biomass charcoal support; and.

S2, subjecting Mo oxide and the above biomass charcoal support to vibration grinding to obtain a biomass charcoal loading Mo oxide having a particle size of 400-500 μm, i.e. a catalyst.

In the above catalyst, Mo accounts for 1% of the mass of the above biomass charcoal support. The acidification is carried out with an acid medium which has a $H^+$ concentration of 5 mol/L. A volume ratio of the carbonized biomass charcoal to the acid medium is 1:5, and the acidification is carried out at a temperature of 80° C. for a period of 1 h.

Preparation of Biomass Slurry:

The pretreated biomass and the above catalyst are mixed with sulfur to obtain a mixture, and the mixture is added to a mixed oil of hogwash oil and residual oil to carry out stirring grinding to form a slurry. The wheat straw is present in a total amount of 55 wt % in the slurry, and the slurry has a viscosity of 500 mPa·s (50° C.). Further, in the slurry, the catalyst accounts for 1 wt %, and the vulcanizing agent accounts for 0.4 wt % of the mass of the pretreated biomass.

Liquefaction:

Introducing hydrogen into the slurry to carry out a reaction under a pressure of 25 MPa and a temperature of 380° C. to obtain a bio-oil.

Said introducing hydrogen into the slurry comprises: introducing a high-pressure hydrogen into the slurry to prepare a reaction raw material mixture, wherein the high-pressure hydrogen and the slurry have a volume ratio of 1500:1; and heating the reaction raw material mixture to 380° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.2 m/s; wherein, the high-pressure hydrogen has a pressure of 27 MPa, and the cold hydrogen has a temperature of 135° C.

The cold hydrogen is injected via 3 injection ports which are sequentially formed in a height direction in a side wall of the slurry bed reactor. The biomass charcoal loading Mo oxide as a catalyst is stored in the slurry bed reactor in an amount of 30 wt % of the mass of liquid in the slurry bed reactor; and the reaction is carried out for a period of 30 min.

Experimental Example

Results for evaluating the effects of the processes provided by the embodiments 1-9 are shown in table 1.

TABLE 1

Product distributions of Embodiments 1-9

| Conversion results | Conversion rate of biomass % | Yield of oil phase % | The amount of residue wt % | Carbon content in oil phase wt % | Hydrogen content in oil phase wt % | Oxygen content in oil phase wt % |
|---|---|---|---|---|---|---|
| Embodiment 1 | 99 | 76.0 | 0.07 | 80 | 19 | 1.0 |
| Embodiment 2 | 98 | 76.0 | 0.08 | 83 | 14 | 3.0 |
| Embodiment 3 | 96 | 79.5 | 0.09 | 89 | 9.0 | 2.0 |
| Embodiment 4 | 97 | 70 | 0.04 | 80 | 18.1 | 1.9 |
| Embodiment 5 | 97 | 75 | 0.09 | 84 | 14 | 2 |
| Embodiment 6 | 95 | 85 | 0.05 | 89 | 10.5 | 0.5 |
| Embodiment 7 | 98 | 60.0 | 0.07 | 80 | 19 | 1 |
| Embodiment 8 | 97 | 85.0 | 0.08 | 90 | 9.9 | 0.1 |
| Embodiment 9 | 95 | 86.0 | 0.09 | 87 | 11.5 | 1.5 |

As shown in table 1, the conversion rate of biomass obtained by the method of the present invention is 95-99%, the yield of oil phase is 60-86%, the amount of residue is less than 0.1 wt %, the carbon content in oil phase is 80-90 wt %, the hydrogen content in oil phase is 9-19 wt %, and the oxygen content in oil phase is 0.1-3 wt %.

Embodiment 11

Provided is a method for preparing a second catalyst described as below.

S1, subjecting carbonized biomass charcoal to acidification or alkalization, thereby obtaining a second biomass charcoal support. Particularly, the acidification is carried out with an acid medium which has a $H^+$ concentration of 5 mol/L. A volume ratio of the carbonized biomass charcoal to the acid medium is 1:15, and the acidification is carried out at a temperature of 80° C. for a period of 10 h. The alkalization is carried out with an alkaline medium which has an OH concentration of 0.5 mol/L, and a volume ratio of the carbonized biomass charcoal to the alkaline medium is 1:5, and the alkalization is carried out at a temperature of 30° C. for a period of 10 h.

S2, subjecting a second active component and the second biomass charcoal support to vibration grinding and/or plane grinding and/or ball milling, thereby obtaining a second catalyst with a particle size of 100-200 μm.

The second active component is an oxide loading Mo and W, and based on mass of metal elements, the second active component accounts for 5% of the mass of the second biomass charcoal support.

Embodiment 12

Provided is a one-pot liquefaction process for biomass described as below.

(1) Corn straw is fed into a drier to be dried to have a moisture content of 3 wt %, and then fed to a pulverizer for pulverization to a particle size of 1-50 μm, and then removed dust to obtain straw particles.

(2) Amorphous alumina (having a particle size of 5-50 μm) loading Mo oxide and Co oxide is mixed with the straw particles obtained in the step (1) and sulfur uniformly according to a mass ratio of 5:100:0.3, thereby obtaining a mixture; and the mixture is added into medium/low temperature coal tar to form a slurry with a biomass content of 10 wt %.

(3) Firstly, introducing a high-pressure hydrogen having a pressure of 13 MPa and a temperature of 60° C. into the slurry till the volume ratio of the high-pressure hydrogen to the slurry is 50:1, and heating the slurry to 200° C. in a heat exchanger, and secondly, introducing a high-pressure hydrogen having a pressure of 13 MPa and a temperature of 200° C. into the slurry, wherein the total volume of the high-pressure hydrogen introduced twice and the slurry have a volume ratio of 800:1, obtaining a reaction raw material mixture; and heating the reaction raw material mixture to 450° C. and feeding it into a slurry bed reactor to undergo hydrolysis, cracking and hydrogenation reactions under a pressure of 13 MPa and a temperature of 500° C. During the reaction process, cold hydrogen with a temperature of 105° C. is introduced via 3 injection ports which are sequentially formed in a height direction in a side wall of the slurry bed reactor, wherein a total gas speed in the slurry bed reactor is controlled at 0.02 m/s, and the catalyst stored in the slurry bed reactor is controlled in an amount of 30 wt % of the total mass of the liquid phase and the solid phase in the slurry bed reactor. After reacting for 90 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site in the step (3) together with fresh supplementary hydrogen.

Embodiment 13

Provided is a one-pot liquefaction process for biomass described as below.

(1) Reeds are fed into a drier to be dried to have a moisture content of 5 wt %, and then fed to a pulverizer for pulverization to a particle size of 20-1000 μm, and then removed dust to obtain straw particles.

(2) Biomass charcoal (having a particle size of 100-150 μm) loading W oxide and Ni oxide is mixed with amorphous FeOOH, the reed particles obtained in the step (1) and sulfur uniformly according to a mass ratio of 2:2:100:0.4, thereby obtaining a mixture; and the mixture is added into vegetable oil, thereby obtaining a slurry with a biomass content of 30 wt %.

(3) Firstly, introducing a high-pressure hydrogen having a pressure of 20 MPa and a temperature of 70° C. into the slurry till the volume ratio of the high-pressure hydrogen to the slurry is 100:1, and heating the slurry to 250° C. in a heat exchanger, and secondly, introducing a high-pressure hydrogen having a pressure of 20 MPa and a temperature of 250° C. into the slurry, wherein the total volume of the high-pressure hydrogen introduced twice and the slurry have a volume ratio of 900:1, obtaining a reaction raw material mixture; and heating the reaction raw material mixture to 430° C. and feeding it into a slurry bed reactor to undergo hydrolysis, cracking and hydrogenation reactions under a pressure of 20 MPa and a temperature of 450° C. During the reaction process, cold hydrogen with a temperature of 120° C. is injected via 4 injection ports which are sequentially formed in a height direction in a side wall of the slurry bed reactor, wherein a total gas speed in the slurry bed reactor is controlled at 0.06 m/s, and the catalyst stored in the slurry bed reactor is controlled in an amount of 25 wt % of the total mass of the liquid phase and the solid phase in the slurry bed reactor. After reacting for 60 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site in the step (3) together with fresh supplementary hydrogen.

Embodiment 14

Provided is a one-pot liquefaction process for biomass described as below.

(1) Wheat straw is fed into a drier to be dried to have a moisture content of 7 wt %, and then fed to a pulverizer for pulverization to a particle size of 1500-2000 μm, and then removed dust to obtain straw particles.

(2) Biomass charcoal (having a particle size of 50-100 μm) loading Pd oxide and Ni oxide is mixed with amorphous FeOOH, the straw particles obtained in the step (1) and sulfur uniformly according to a mass ratio of 2:3:100:0.3, thereby obtaining a mixture; and the mixture is added into low-temperature animal oil, thereby obtaining a slurry with a biomass content of 25 wt %.

(3) Firstly, introducing a high-pressure hydrogen having a pressure of 17 MPa and a temperature of 100° C. into the slurry till the volume ratio of the high-pressure hydrogen to the slurry is 150:1, and heating the slurry to 300° C. in a heat exchanger, and secondly, introducing a high-pressure hydrogen having a pressure of 17 MPa and a temperature of 300°

C. into the slurry, wherein the total volume of the high-pressure hydrogen introduced twice and the slurry have a volume ratio of 600:1, obtaining a reaction raw material mixture; and heating the reaction raw material mixture to 440° C. and feeding it into a slurry bed reactor to undergo hydrolysis, cracking and hydrogenation reactions under a pressure of 20 MPa and a temperature of 450° C. During the reaction process, cold hydrogen with a temperature of 90° C. is injected via 4 injection ports which are sequentially formed in a height direction in a side wall of the slurry bed reactor, wherein a total gas speed in the slurry bed reactor is controlled at 0.08 m/s, and the catalyst stored in the slurry bed reactor is controlled in an amount of 20 wt % of the total mass of the liquid phase and the solid phase in the slurry bed reactor. After reacting for 40 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site in the step (3) together with fresh supplementary hydrogen.

Embodiment 15

Provided is one-pot liquefaction process for biomass described as below.

(1) Wood chips are fed into a drier to be dried to have a moisture content of 10 wt %, and then fed to a pulverizer for pulverization to a particle size of 4000-5000 μm, and then removed dust to obtain straw particles.

(2) Amorphous FeOOH (having a particle size of 150-200 μm) is mixed with the wood chip particles obtained in the step (1) and sulfur uniformly according to a mass ratio of 10:100:0.2, thereby obtaining a mixture; and the mixture is added into low-temperature animal oil to obtain a slurry with a biomass content of 40 wt %.

(3) Firstly, introducing a high-pressure hydrogen having a pressure of 27 MPa and a temperature of 130° C. into the slurry till the volume ratio of the high-pressure hydrogen to the slurry is 200:1, and heating the slurry to 350° C. in a heat exchanger, and secondly, introducing a high-pressure hydrogen having a pressure of 27 MPa and a temperature of 300° C. into the slurry, wherein the total volume of the high-pressure hydrogen introduced twice and the slurry have a volume ratio of 1000:1, obtaining a reaction raw material mixture; and heating the reaction raw material mixture to 300° C. and feeding it into a slurry bed reactor to undergo hydrolysis, cracking and hydrogenation reactions under a pressure of 27 MPa and a temperature of 300° C. During the reaction process, cold hydrogen with a temperature of 115° C. is injected via 5 injection ports which are sequentially formed in a height direction in a side wall of the slurry bed reactor, wherein a total gas speed in the slurry bed reactor is controlled at 0.1 m/s, and the catalyst stored in the slurry bed reactor is controlled in an amount of 30 wt % of the mass of the liquid phase in the slurry bed reactor. After reacting for 50 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site in the step (3) together with fresh supplementary hydrogen.

Embodiment 16

Provided is one-pot liquefaction process for biomass described as below.

(1) Leaves are fed into a drier to be dried to have a moisture content of 15 wt %, and then fed to a pulverizer for pulverization to a particle size of 4000-5000 μm, and then removed dust to obtain leaves particles.

(2) The catalyst prepared in the embodiment 1 is mixed with amorphous FeOOH, the leaves particles obtained in the step (1) and sulfur uniformly according to a mass ratio of 1:0.2:100:0.25, thereby obtaining a mixture; and the mixture is added into low-temperature vegetable oil to obtain a slurry with a biomass content of 20 wt %.

(3) Firstly, introducing a high-pressure hydrogen having a pressure of 25 MPa and a temperature of 135° C. into the slurry till the volume ratio of the high-pressure hydrogen to the slurry is 200:1, and heating the slurry to 350° C. in a heat exchanger, and secondly, introducing a high-pressure hydrogen having a pressure of 25 MPa and a temperature of 350° C. into the slurry, wherein the total volume of the high-pressure hydrogen introduced twice and the slurry have a volume ratio of 650:1, obtaining a reaction raw material mixture; and heating the reaction raw material mixture to 400° C. and feeding it into a slurry bed reactor to undergo hydrolysis, cracking and hydrogenation reactions under a pressure of 25 MPa and a temperature of 450° C. During the reaction process, cold hydrogen with a temperature of 100° C. is injected via 5 injection ports which are sequentially formed in a height direction in a side wall of the slurry bed reactor, wherein a total gas speed in the slurry bed reactor is controlled at 0.1 m/s, and the catalyst stored in the slurry bed reactor is controlled in an amount of 25 wt % of the mass of the liquid phase in the slurry bed reactor. After reacting for 15 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site in the step (3) together with fresh supplementary hydrogen.

Comparative Example

Provided is one-pot liquefaction process for biomass described as below.

(1) Reeds are fed into a drier to be dried to have a moisture content of 5 wt %, and then fed to a pulverizer for pulverization to a particle size of 20-1000 μm, and then removed dust to obtain reed particles.

(2) Biomass charcoal (having a particle size of 100-150 μm) loading W oxide and Ni oxide is mixed with amorphous FeOOH, the reed particles obtained in the step (1) and sulfur uniformly according to a mass ratio of 2:2:100:0.4, thereby obtaining a mixture; and the mixture is added into vegetable oil to obtain a slurry with a biomass content of 30 wt %.

(3) Firstly, introducing a high-pressure hydrogen having a pressure of 20 MPa and a temperature of 70° C. into the slurry till the volume ratio of the high-pressure hydrogen to the slurry is 100:1, and heating the slurry to 250° C. in a heat exchanger, and secondly, introducing a high-pressure hydrogen having a pressure of 20 MPa and a temperature of 250° C. into the slurry, wherein the total volume of the high-pressure hydrogen introduced twice and the slurry have a volume ratio of 900:1, obtaining a reaction raw material mixture; and heating the reaction raw material mixture to 430° C. and feeding it into a slurry bed reactor to undergo hydrolysis, cracking and hydrogenation reactions under a pressure of 10 MPa and a temperature of 200° C. During the reaction process, cold hydrogen with a temperature of 120°

C. is injected via 4 injection ports which are sequentially formed in a height direction in a side wall of the slurry bed reactor, wherein a total gas speed in the slurry bed reactor is controlled at 0.06 m/s, and the catalyst stored in the slurry bed reactor is controlled in an amount of 25 wt % of the mass of the liquid phase in the slurry bed reactor. After reacting for 60 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site in the step (3) together with fresh supplementary hydrogen.

Experimental Example

Results for evaluating the effects of the processes provided by the embodiments 12-16 and comparative example are shown in table 2.

As shown in table 2, the conversion rate of biomass and the yield of biomass oil of embodiments 12-16 are obviously higher than those of the comparative example, and residue content of embodiments 12-16 is obviously lower than that of the comparative example.

Carbon content and hydrogen content in the biomass oil of embodiments 12-16 are obviously higher than that of the comparative example, while oxygen content is obviously lower than that of the comparative example. By the comparison of embodiments 12-16 with the comparative example, the one-pot liquefaction process for biomass of the present invention is obviously superior to the existing liquefaction process for biomass.

TABLE 2

| Process effect | | | | | | |
|---|---|---|---|---|---|---|
| | Embodiment No. | | | | | |
| Test item | 12 | 13 | 14 | 15 | 16 | Comparative example |
| Conversion rate of biomass % | 95 | 92 | 90 | 91 | 99 | 80 |
| Yield of biomass oil % | 71 | 69 | 61 | 64 | 85.6 | 50 |
| Residue content % | 0.06 | 0.03 | 0.04 | 0.04 | 0.01 | 2 |
| Carbon content in the biomass oil % | 86 | 88 | 87 | 85 | 87 | 75 |
| Hydrogen content in the biomass oil % | 8.9 | 9.2 | 9.6 | 9.5 | 10.1 | 8.2 |
| Oxygen content in the biomass oil % | 4.1 | 2.4 | 2.8 | 4.8 | 2.1 | 16 |

The following are embodiments of the one-pot liquefaction process for coal and biomass provided by the present invention. In each of the following embodiments and comparative examples, calculation formulas for conversion rate of biomass, yield of biomass oil, and residue content are as follows:

Conversion rate of coal and biomass=(the mass of liquefaction product−the mass of vulcanizing agent−mass of the catalyst−mass of the solvent oil)/the total mass of coal and biomass.

Yield of biomass oil=the mass of oil phase obtained after separation of the product of the liquefaction product/the total mass of coal and biomass.

Residue content=the mass of residue/the total mass of coal and biomass.

Embodiment 17

Provided is a method for preparing a second catalyst described as below.

Preparation of Biomass Charcoal Support

Subjecting biomass charcoal to acidification by using an acid medium having a $H^+$ concentration of 5 mol/L at a temperature of 80° C. for a period of 10 h to obtain a biomass charcoal support, wherein the volume ratio of the acid medium to the biomass charcoal is 15:1. As an alternative, an alkaline medium having an $OH^-$ concentration of 0.5 mol/L can also be used for carrying out acidification to the biomass carbon at a volume ratio of 5:1 at 30° C. for 10 h.

Loading a Second Active Component

Subjecting Mo oxide, W oxide and the above biomass charcoal support to vibration grinding to load active component onto the biomass charcoal support to obtain a second catalyst having a particle size of 100-200 μm. Based on mass of metal elements, the second active component accounts for 5% of the mass of the biomass charcoal support.

Embodiment 18

Provided is one-pot liquefaction process for biomass and coal described as below.

Pretreatment of Straw

Corn straw is subjected to drying and dehydration to have a moisture content of less than 2 wt %, and then pulverized to a median diameter of 100 μm, then sent to a plodder for extrusion molding under a molding pressure of 2 MPa to obtain a compressed straw material.

The compressed straw material is fed to a hammer mill for pulverization to obtain pulverized straw material having a particle size of 50 μm.

Pretreatment of Coal Raw Material

Lignite is subjected to drying and dehydration, and then pulverized to a median diameter of 100 μm, then sent to a plodder for extrusion molding under a molding pressure of 5 MPa to obtain a compressed lignite material.

The compressed lignite material is sent to a ball mill for pulverization to obtain pulverized lignite having a particle size of 30 μm.

Preparation of Biomass Coal Slurry and Liquefaction Reaction

The above pulverized straw material and pulverized lignite are firstly subjected to dust removing, and then mixed with amorphous alumina (having a particle size of 5-50 μm) loading with Mo oxide and Co oxide and sulfur according to a mass ratio of 100:5:0.3 to obtain a mixture, and the mixture is added to sour oil to form biomass coal slurry. In the biomass coal slurry, the straw has a content of 20 wt % and the lignite has a content of 45 wt %.

Introducing high-pressure hydrogen having a temperature of 60° C. and a pressure of 15 MPa into the biomass coal slurry, wherein the volume of the introduced high-pressure hydrogen is 50 times the volume of the biomass coal slurry, and heating the slurry to 200° C. in a heat exchanger, and then introducing hydrogen having a pressure of 15 MPa and a temperature of 200° C. into the slurry, wherein the total volume of the hydrogen introduced twice and the slurry have a volume ratio of 800:1, obtaining a reaction raw material mixture; and heating the reaction raw material mixture to 450° C. and feeding it into a slurry bed reactor to undergo hydrolysis, cracking and hydrogenation reactions under a pressure of 15 MPa and a temperature of 460° C. During the reaction process, cold hydrogen with a temperature of 105°

C. is injected via 3 injection ports which are sequentially formed in a height direction in a side wall of the slurry bed reactor, wherein a total gas speed in the slurry bed reactor is controlled at 0.02 m/s, and the catalyst stored in the slurry bed reactor is controlled in an amount of 30 wt % of the mass of the liquid and solid phases in the slurry bed reactor. After reacting for 70 min, materials are discharged from the slurry bed reactor and are fed into a separation system to undergo gas, liquid and solid separation, thereby obtaining a biomass gas, a bio-oil and residues, respectively. The hydrogen in the reaction system is recycled and is fed into each hydrogen injection site mentioned above together with fresh supplementary hydrogen.

Embodiment 19

Provided is one-pot liquefaction process for biomass and coal described as below.

Pretreatment of Straw

Corn straw is subjected to drying and dehydration to have a moisture content of less than 1 wt %, and then pulverized to a median diameter of 100 μm, then sent to a plodder for extrusion molding under a molding pressure of 2 MPa to obtain a compressed straw material.

The compressed straw material is sent to a hammer mill for pulverization to obtain pulverized straw material having a particle size of 50 μm.

Pretreatment of Coal Raw Material

Lignite is subjected to drying and dehydration, and then pulverized to a median diameter of 50 μm, then sent to a plodder for extrusion molding under a molding pressure of 5 MPa to obtain a compressed lignite material.

The compressed lignite material is sent to a ball mill for pulverization to obtain pulverized lignite having a particle size of 30 μm.

Preparation of Biomass Water Coal Slurry and Liquefaction Reaction

The above pulverized straw material and pulverized lignite are firstly subjected to dust removing, and then mixed with amorphous alumina (having a particle size of 5-50 μm) loading with Mo oxide and Co oxide and sulfur according to a mass ratio of 100:5:0.3 to obtain a mixture, and the mixture is added to water to form biomass water coal slurry, wherein the straw has a content of 15 wt % and the lignite has a content of 40 wt %.

Introducing high-pressure hydrogen having a temperature of 60° C. and a pressure of 13 MPa into the resulting biomass water coal slurry, wherein the volume of the introduced high-pressure hydrogen is 50 times the volume of the of the slurry, and heating the slurry to 200° C. in a heat exchanger, and then introducing hydrogen having a pressure of 13 MPa and a temperature of 200° C. into the slurry, wherein the total volume of the hydrogen introduced twice and the slurry have a volume ratio of 800:1, obtaining a reaction raw material mixture; and heating the reaction raw material mixture to 450° C. and feeding it into a slurry bed reactor to undergo hydrolysis, cracking and hydrogenation reactions under a pressure of 15 MPa and a temperature of 300° C. During the reaction process, cold hydrogen with a temperature of 105° C. is injected via 3 injection ports which are sequentially formed in a height direction in a side wall of the slurry bed reactor, wherein a total gas speed in the slurry bed reactor is controlled at 0.02 m/s, and the catalyst stored in the slurry bed reactor is controlled in an amount of 30 wt % of the mass of the liquid and solid phases in the slurry bed reactor. After reacting for 60 min, materials are discharged from the slurry bed reactor are fed into a separation system to undergo gas, liquid and solid separation, thereby obtaining a biomass gas, a bio-oil and residues, respectively. The hydrogen in the reaction system is recycled and is fed into each hydrogen injection site mentioned above together with fresh supplementary hydrogen.

Embodiment 20

Provided is one-pot liquefaction process for biomass and coal described as below.

Pretreatment of Biomass Materials:

(1) Reeds are dried to have a moisture content of 1 wt %, and then fed to a pulverizer for pulverization to obtain a first reed pulverized material having a particle size $D_{50}$ of 200 μm.

(2) The first reed pulverized material is sent to a briquetting press or a plodderfor extrusion molding under a molding pressure of 3 MPa to obtain reeds compressed materials.

(3) The reeds compressed materials are fed to a pulverizer for second pulverization to obtain a second reed pulverized material having a particle size $D_{50}$ of 40 μm.

Pretreatment of Coal Raw Material:

(1) Shendong long flame coal is subjected to drying and dehydration, and then fed to a ball mill for pulverization to obtain a first pulverized material having a particle size $D_{50}$ of 50 μm.

(2) The first pulverized material is sent to a briquetting press or a plodder for extrusion molding under a molding pressure of 12 MPa to obtain compressed materials.

(3) The compressed materials are fed to a pulverizer for a second pulverization to obtain a second pulverized material having a particle size $D_{50}$ of 80 μm.

Preparation of Biomass Water Coal Slurry and Liquefaction Reaction

The second pulverized reed material and the second pulverized coal material are mixed with biomass charcoal (having a particle size of 100-150 μm) loading W oxide and Ni oxide, FeOOH, and sulfur uniformly according to a mass ratio of 100:2:2:0.4, thereby obtaining a mixture; and the mixture is added into water, thereby obtaining a biomass water coal slurry with a reed content of 20 wt % and a coal content of 40 wt %.

Introducing a high-pressure hydrogen having a pressure of 20 MPa and a temperature of 70° C. into the slurry till the volume ratio of the high-pressure hydrogen to the slurry is 100:1, and heating the slurry to 250° C. in a heat exchanger, and then introducing hydrogen having a pressure of 20 MPa and a temperature of 250° C. into the slurry, wherein the total volume of the high-pressure hydrogen introduced twice and the slurry have a volume ratio of 900:1, obtaining a reaction raw material mixture; and heating the reaction raw material mixture to 430° C. and feeding it into a slurry bed reactor to undergo hydrolysis, cracking and hydrogenation reactions under a pressure of 20 MPa and a temperature of 450° C. During the reaction process, cold hydrogen with a temperature of 120° C. is injected via 4 injection ports which are sequentially formed in a height direction in a side wall of the slurry bed reactor, wherein a total gas speed in the slurry bed reactor is controlled at 0.06 m/s, and the catalyst stored in the slurry bed reactor is controlled in an amount of 25 wt % of the total mass of the liquid phase and the solid phase in the slurry bed reactor. After reacting for 60 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Embodiment 21

Provided is one-pot liquefaction process for biomass and coal described as below.

Pretreatment of Biomass and Coal Raw Material:

Palm oil residue and lignite are subjected to drying and dehydration, and then fed to a briquetting press for extrusion molding under a molding pressure of 5 MPa to obtain compressed materials of palm oil residue and lignite, which are then fed to a ball mill for pulverization to obtain a pulverized material of palm oil residue and lignite having a median diameter of 50 μm.

Preparation of Biomass Water Coal Slurry and Hydrolysis Hydrogenation Reaction

The above pulverized material is mixed with amorphous alumina (having a particle size of 350-500 μm) loading Mo oxide and Ni oxide and sulfur uniformly according to a mass ratio of 100:1:0.1, thereby obtaining a mixture; and the mixture is added into water, thereby obtaining a biomass water coal slurry with a palm oil residue content of 20 wt % and a coal content of 45 wt %.

Introducing a high-pressure hydrogen having a pressure of 20 MPa and a temperature of 90° C. into the slurry till the volume ratio of the high-pressure hydrogen to the slurry is 150:1, and heating the slurry to 300° C. in a heat exchanger, and then introducing hydrogen having a pressure of 20 MPa and a temperature of 300° C. into the slurry, wherein the total volume of the high-pressure hydrogen introduced twice and the slurry have a volume ratio of 800:1, obtaining a reaction raw material mixture; and heating the reaction raw material mixture to 430° C. and feeding it into a slurry bed reactor to undergo hydrolysis, cracking and hydrogenation reactions under a pressure of 20 MPa and a temperature of 460° C. During the reaction process, cold hydrogen with a temperature of 120° C. is injected via 5 injection ports which are sequentially formed in a height direction in a side wall of the slurry bed reactor, wherein a total gas speed in the slurry bed reactor is controlled at 0.07 m/s, and the catalyst stored in the slurry bed reactor is controlled in an amount of 30 wt % of the total mass of the liquid phase in the slurry bed reactor. After reacting for 40 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Embodiment 22

Provided is one-pot liquefaction process for coal and biomass described as below.

Pretreatment of Biomass Materials:

(1) Soybean oil residue is subjected to drying and dehydration, and then fed to a pulverizer for a first pulverization to obtain a first pulverized material of soybean oil residue having a particle size $D_{50}$ of 250 μm.

(2) The first pulverized material is sent to a briquetting press or a plodder for extrusion molding under a molding pressure of 5 MPa to obtain a compressed material of soybean oil residue.

(3) The compressed material is fed to a pulverizer for a second pulverization to obtain a second pulverized material of soybean oil residue having a particle size $D_{50}$ of 45 μm.

Pretreatment of Coal Raw Material (1) Shendong long flame coal is subjected to drying and dehydration, and then fed to a ball mill for pulverization to obtain a first pulverized material having a particle size $D_{50}$ of 60 μm.

(2) The first pulverized material is sent to a briquetting press or a plodder for extrusion molding under a molding pressure of 10 MPa to obtain a compressed material.

(3) The compressed material is fed to a ball mill for carrying out a second pulverization to obtain a second pulverized material having a particle size $D_{50}$ of 40 μm.

Preparation of Biomass Coal Slurry and Liquefaction Reaction

The present embodiment adopts a catalyst prepared by embodiment 1. The second pulverized material of soybean oil residue and the second pulverized material of coal are uniformly mixed with the above catalyst, FeOOH, and sulfur according to a mass ratio of 100:1:0.2:0.25, thereby obtaining a mixture; and the mixture is added into a waste lubricating oil, thereby obtaining a biomass coal slurry with a soybean oil residue content of 20 wt % and a coal content of 40 wt %.

Introducing a high-pressure hydrogen having a pressure of 25 MPa and a temperature of 135° C. into the slurry till the volume ratio of the high-pressure hydrogen to the slurry is 200:1, and heating the slurry to 350° C. in a heat exchanger, and then introducing hydrogen having a pressure of 25 MPa and a temperature of 350° C. into the slurry, wherein the total volume of the high-pressure hydrogen introduced twice and the slurry have a volume ratio of 650:1, obtaining a reaction raw material mixture; and heating the reaction raw material mixture to 400° C. and feeding it into a slurry bed reactor to undergo hydrolysis, cracking and hydrogenation reactions under a pressure of 25 MPa and a temperature of 450° C. During the reaction process, cold hydrogen with a temperature of 100° C. is injected via 5 injection ports which are sequentially formed in a height direction in a side wall of the slurry bed reactor, wherein a total gas speed in the slurry bed reactor is controlled at 0.1 m/s, and the catalyst stored in the slurry bed reactor is controlled in an amount of 25 wt % of the total mass of the liquid phase in the slurry bed reactor. After reacting for 15 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Embodiment 23

Provided is one-pot liquefaction process for coal and biomass described as below.

Pretreatment of Biomass and Coal Raw Material:

Palm oil residue and lignite are subjected to drying and dehydration to have a moisture content of less than 2 wt %, and then fed to a briquetting press for extrusion molding under a molding pressure of 5 MPa to obtain a compressed material of palm oil residue and lignite, which is then fed to a ball mill for pulverization to obtain a pulverized material of palm oil residue and lignite.

Preparation of Biomass Water Coal Slurry and Liquefaction Hydrogenation Reaction The above pulverized material is mixed uniformly with amorphous alumina (having a particle size of 350-500 μm) loading Mo oxide and Ni oxide, and sulfur according to a mass ratio of 100:1:0.1, thereby obtaining a mixture; and the mixture is added into gutter oil, thereby obtaining a biomass water coal slurry with a palm oil residue content of 25 wt % and a coal content of 40 wt %.

Introducing a high-pressure hydrogen having a pressure of 20 MPa and a temperature of 90° C. into the slurry till the volume ratio of the high-pressure hydrogen to the slurry is 150:1, and heating the slurry to 300° C. in a heat exchanger, and then introducing hydrogen having a pressure of 20 MPa and a temperature of 300° C. into the slurry, wherein the total volume of the high-pressure hydrogen introduced twice and the slurry have a volume ratio of 800:1, obtaining a reaction raw material mixture; and heating the reaction raw material mixture to 430° C. and feeding it into a slurry bed reactor to undergo hydrolysis, cracking and hydrogenation reactions under a pressure of 20 MPa and a temperature of 420° C. During the reaction process, cold hydrogen with a temperature of 120° C. is injected via 5 injection ports which are sequentially formed in a height direction in a side wall of the slurry bed reactor, wherein a total gas speed in the slurry bed reactor is controlled at 0.07 m/s, and the catalyst stored in the slurry bed reactor is controlled in an amount of 40 wt % of the total mass of the liquid phase in the slurry bed reactor. After reacting for 40 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Embodiment 24

Provided is one-pot liquefaction process for coal and biomass described as below.

Pretreatment of Biomass Raw Material:

(1) Reeds are dried to have a moisture content of 1 wt %, and then fed to a pulverizer for pulverization to obtain a first reed pulverized material having a particle size $D_{50}$ of 300 μm.

(2) The first reed pulverized material is sent to a briquetting press or a plodderfor extrusion molding under a molding pressure of 5 MPa to obtain a compressed reed material.

(3) The compressed reed material is fed to a pulverizer for a second pulverization to obtain a second pulverized material of reed having a particle size $D_{50}$ of 30 μm.

Pretreatment of Coal Raw Material:

(1) Shendong long flame coal is subjected to drying and dehydration, and then fed to a ball mill for pulverization to obtain a first pulverized material having a particle size $D_{50}$ of 50 μm.

(2) The first pulverized material is sent to a briquetting press or a plodder for extrusion molding under a molding pressure of 15 MPa to obtain a compressed material.

(3) The compressed material is fed to a ball mill for a second pulverization to obtain a second pulverized material having a particle size $D_{50}$ of 45 μm.

Preparation of Biomass Coal Slurry and Liquefaction Reaction

The second pulverized material of reeds and coal is mixed with biomass charcoal (having a particle size of 100-150 μm) loading W oxide and Ni oxide, FeOOH, and sulfur uniformly according to a mass ratio of 100:2:2:0.4, thereby obtaining a mixture; and the mixture is added into a waste engine oil, thereby obtaining a biomass coal slurry with a reed content of 30 wt % and a coal content of 30 wt %.

Introducing a high-pressure hydrogen having a pressure of 17 MPa and a temperature of 70° C. into the slurry till the volume ratio of the high-pressure hydrogen to the slurry is 100:1, and heating the slurry to 250° C. in a heat exchanger, and then introducing hydrogen having a pressure of 17 MPa and a temperature of 250° C. into the slurry, wherein the total volume of the high-pressure hydrogen introduced twice and the slurry have a volume ratio of 900:1, obtaining a reaction raw material mixture; and heating the reaction raw material mixture to 430° C. and feeding it into a slurry bed reactor to undergo hydrolysis, cracking and hydrogenation reactions under a pressure of 17 MPa and a temperature of 450° C. During the reaction process, cold hydrogen with a temperature of 120° C. is injected via 4 injection ports which are sequentially formed in a height direction in a side wall of the slurry bed reactor, wherein a total gas speed in the slurry bed reactor is controlled at 0.06 m/s, and the catalyst stored in the slurry bed reactor is controlled in an amount of 25 wt % of the total mass of the liquid phase and the solid phase in the slurry bed reactor. After reacting for 60 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Comparative Example 1

Provided is comparative one-pot liquefaction process for coal and biomass described as below.

Pretreatment of Biomass Raw Material:

(1) Reeds are fed into a drier to have a moisture content of 1.5 wt %, and then fed to a pulverizer for pulverization to obtain a first reed pulverized material having a particle size $D_{50}$ of 200 μm.

(2) The first reed pulverized material is sent to a briquetting press or a plodderfor extrusion molding under a molding pressure of 3 MPa to obtain a reed compressed material.

(3) The reed compressed material is fed to a pulverizer for a second pulverization to obtain a second reed pulverized material having a particle size $D_{50}$ of 40 μm.

Pretreatment of Coal Raw Material:

(1) Shendong long flame coal is subjected to drying and dehydration, and then fed to a ball mill for pulverization to obtain a first pulverized material having a particle size $D_{50}$ of 80 μm.

(2) The first pulverized material is sent to a briquetting press or a plodder for extrusion molding under a molding pressure of 12 MPa to obtain a compressed material.

(3) The compressed material is fed to a ball mill for a second pulverization to obtain a second pulverized material having a particle size $D_{50}$ of 80 μm.

Preparation of Biomass Water Coal Slurry and Liquefaction Reaction

The second pulverized material of reeds and coal is mixed with water-soluble dispersive hydrogenation catalyst after vulcanization uniformly according to a mass ratio of 100:4.4, thereby obtaining a mixture; and the mixture is added into water, thereby obtaining a biomass water coal slurry with a reed content of 20 wt % and a coal content of 45 wt %.

Introducing a high-pressure hydrogen having a pressure of 20 MPa and a temperature of 70° C. into the slurry till the volume ratio of the high-pressure hydrogen to the slurry is 100:1, and heating the slurry to 250° C. in a heat exchanger, and then introducing hydrogen having a pressure of 20 MPa and a temperature of 250° C. into the slurry, wherein the total volume of the high-pressure hydrogen introduced twice and the slurry have a volume ratio of 900:1, obtaining a reaction raw material mixture; and heating the reaction raw material mixture to 430° C. and feeding it into a slurry bed reactor to undergo hydrolysis, cracking and hydrogenation reactions under a pressure of 20 MPa and a temperature of 450° C. During the reaction process, cold hydrogen with a temperature of 120° C. is injected via 4 injection ports which are sequentially formed in a height direction in a side wall of the slurry bed reactor, wherein a total gas speed in the slurry bed reactor is controlled at 0.06 m/s, and the catalyst stored in the slurry bed reactor is controlled in an amount of 25 wt % of the total mass of the liquid phase and the solid phase in the slurry bed reactor. After reacting for 60 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Comparative Example 2

Provided is comparative one-pot liquefaction process for coal and biomass described as below.

Pretreatment of Biomass Raw Material:

(1) Reeds are fed into a drier to have a moisture content of 1 wt %, and then fed to a pulverizer for pulverization to obtain a first reed pulverized material having a particle size $D_{50}$ of 300 μm.

(2) The first reed pulverized material is sent to a briquetting press or a plodderfor extrusion molding under a molding pressure of 5 MPa to obtain a reed compressed material.

(3) The reed compressed material is fed to a pulverizer for a second pulverization to obtain a second reed pulverized material having a particle size $D_{50}$ of 30 μm.

(3) The compressed material is fed to a ball mill for a second pulverization to obtain a second pulverized material having a particle size $D_{50}$ of 45 μm.

Preparation of Biomass Coal Slurry and Liquefaction Reaction

The second pulverized material of reeds and coal is mixed with water-soluble dispersive hydrogenation catalyst after vulcanization uniformly according to a mass ratio of 100:2, thereby obtaining a mixture; and the mixture is added into waste engine oil, thereby obtaining a biomass coal slurry with a reed content of 30 wt % and a coal content of 30 wt %.

Introducing a high-pressure hydrogen having a pressure of 17 MPa and a temperature of 70° C. into the slurry till the volume ratio of the high-pressure hydrogen to the slurry is 100:1, and heating the slurry to 250° C. in a heat exchanger, and then introducing hydrogen having a pressure of 17 MPa and a temperature of 250° C. into the slurry, wherein the total volume of the high-pressure hydrogen introduced twice and the slurry have a volume ratio of 900:1, obtaining a reaction raw material mixture; and heating the reaction raw material mixture to 430° C. and feeding it into a slurry bed reactor to undergo hydrolysis, cracking and hydrogenation reactions under a pressure of 17 MPa and a temperature of 450° C. During the reaction process, cold hydrogen with a temperature of 120° C. is injected via 4 injection ports which are sequentially formed in a height direction in a side wall of the slurry bed reactor, wherein a total gas speed in the slurry bed reactor is controlled at 0.06 m/s, and the catalyst stored in the slurry bed reactor is controlled in an amount of 25 wt % of the total mass of the liquid phase and the solid phase in the slurry bed reactor. After reacting for 60 min, materials are discharged from the slurry bed reactor and are fed into a separation system to undergo gas, liquid and residue separation, thereby obtaining a biomass gas, a bio-oil and residues, respectively. The hydrogen in the reaction system is recycled and is fed into each hydrogen injection site mentioned above together with fresh supplementary hydrogen.

Results for evaluating the effects of the processes provided by the embodiments 18-24 and comparative examples are shown in table 3.

TABLE 3

| Process effect | | | | | | | | | | |
|---|---|---|---|---|---|---|---|---|---|---|
| | | Embodiment No. | | | | | | | | |
| Item | | 18 | 19 | 20 | 21 | 22 | 23 | 24 | Comparative example 1 | Comparative example 2 |
| Conversion rate (%) | | 93 | 95 | 92 | 93 | 94 | 99 | 96 | 79 | 76 |
| Yield of biomass oil (%) | | 79 | 79 | 76 | 85 | 73 | 95 | 80 | 49 | 53 |
| Residue content (%) | | 0.8 | 0.4 | 2 | 0.3 | 1 | 0.3 | 1 | 10 | 5 |
| Main element content of the resulting oil (wt %) | C | 90 | 86 | 90 | 87 | 87 | 86 | 87 | 65 | 69 |
| | H | 8 | 7 | 6 | 10 | 10 | 7 | 5 | 2 | 8 |
| | O | 0.5 | 1 | 2 | 1 | 0.9 | 1.5 | 1.5 | 7 | 6 |

Pretreatment of Coal Raw Material:

(1) Shendong long flame coal is subjected to drying and dehydration, and then fed to a ball mill for pulverization to obtain a first pulverized material having a particle size $D_{50}$ of 50 μm.

(2) The first pulverized material is sent to a briquetting press or a plodder for extrusion molding under a molding pressure of 15 MPa to obtain a compressed material.

As shown in table 3, when choosing different catalysts, the conversion rate of biomass and the yield of biomass oil of embodiments 18-24 are obviously higher than that of the comparative examples 1 and 2, and residue content of embodiments 18-24 is obviously lower than that of the comparative examples 1 and 2.

Apparently, the aforementioned embodiments are merely examples illustrated for clearly describing the present invention, rather than limiting the implementation ways thereof. For those skilled in the art, various changes and modifications in other different forms can be made on the basis of the aforementioned description. It is unnecessary and impossible to exhaustively list all the implementation ways herein. However, any obvious changes or modifications derived from the aforementioned description are intended to be embraced within the protection scope of the present invention.

We claim:

1. Process for one-pot liquefaction of biomass, comprising the following steps:

preparing a slurry containing a catalyst, a vulcanizing agent and a biomass, and introducing hydrogen into the slurry to carry out a reaction under a pressure of 15-25 MPa and a temperature of 380-480° C., thereby obtaining a bio-oil;

wherein, the slurry is prepared with using straw as the biomass according to the following steps: subjecting the straw sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a straw concentration of 30 wt % to 60 wt %.

2. The process according to claim 1, wherein, said subjecting the straw to compression is carried out under a pressure of 0.5-3 MPa and a temperature of 30-60° C.

3. The process according to claim 1, wherein, said subjecting the straw to drying is carried out at a temperature of 50-70° C. for a period of 3-5 h to obtain a dried straw having a moisture content of less than 2 wt %, and after the first pulverization the dried straw has a median particle size of 100-300 μm, and after the second pulverization the dried straw has a median particle size of 30-50 μm and a bulk density of 400-500 kg/m$^3$.

4. The process according to claim 1, wherein the slurry has a straw content of 55-60 wt %.

5. Process for one-pot liquefaction of biomass according to claim 1, comprising the following steps:

preparing a slurry containing a catalyst, a vulcanizing agent and a biomass, and introducing hydrogen into the slurry to carry out a reaction under a pressure of 15-25 MPa and a temperature of 380-480° C., thereby obtaining a bio-oil;

wherein, the slurry is prepared with using a vegetable oil residue as the biomass according to the following steps: subjecting the vegetable oil residue sequentially to drying, a first pulverization, compression and a second pulverization to obtain a pretreated biomass, and then mixing the pretreated biomass with the catalyst and the vulcanizing agent to obtain a mixture, and adding the mixture to an oil to carry out grinding pulping to obtain the slurry having a vegetable oil residue concentration of 50 wt % to 65 wt %.

6. The process according to claim 5, wherein, said subjecting the vegetable oil residue to compression is carried out under a pressure of 3-5 MPa and a temperature of 40-60° C.

7. The process according to claim 5, wherein, said subjecting the vegetable oil residue to drying is carried out at a temperature of 80-110° C. for a period of 2-6 h to obtain a dried vegetable oil residue having a moisture content of less than 2 wt %, and after the first pulverization the dried vegetable oil residue has a median particle size of 100-300 μm, and after the second pulverization the dried vegetable oil residue has a median particle size of 30-50 μm and a bulk density of 1500-1600 kg/m$^3$.

8. The process according to claim 1, wherein, the oil is selected from the group consisting of waste animal and vegetable oil, waste mineral oil, mineral oil, distillate oil, and any combination thereof.

9. Process for one-pot liquefaction of biomass, comprising the following steps:

preparing a slurry containing a catalyst, a vulcanizing agent and a biomass, and introducing hydrogen into the slurry to carry out a reaction under a pressure of 15-20 MPa and a temperature of 300-400° C., thereby obtaining a bio-oil;

wherein, the slurry is prepared with using straw as the biomass according to the following steps: subjecting the straw sequentially to drying, a first pulverization, compression and a second pulverization to obtain a pretreated biomass, and then mixing the pretreated biomass with the catalyst and the vulcanizing agent to obtain a mixture, and adding the mixture to water to carry out grinding pulping to obtain the slurry having a straw concentration of 35 to 50 wt %.

10. The process according to claim 9, wherein said subjecting the straw to the compression is carried out at under a pressure of 2-5 MPa and a temperature of 30-60° C.

11. The process according to claim 9, wherein, said subjecting the straw to drying is carried out at a temperature of 70-110° C. for a period of 3-5 h to obtain a dried straw having a moisture content of less than 2 wt %, and after the first pulverization the dried straw has a median particle size of 100-300 μm, and after the second pulverization the dried straw has a median particle size of 30-50 μm and a bulk density of 400-800 kg/m$^3$.

12. Process for one-pot liquefaction of biomass, comprising the following steps:

preparing a slurry containing a catalyst, a vulcanizing agent and a biomass, and introducing hydrogen into the slurry to carry out a reaction under a pressure of 15-20 MPa and a temperature of 340-420° C., thereby obtaining a bio-oil;

wherein the slurry is prepared with using a vegetable oil residue as the biomass according to the following steps: subjecting the vegetable oil residue sequentially to drying, a first pulverization, compression and a second pulverization to obtain a pretreated biomass, and then mixing the pretreated biomass with the catalyst and the vulcanizing agent to obtain a mixture, and adding the mixture to water to carry out grinding pulping to obtain the slurry having a vegetable oil residue concentration of 40 to 50 wt %.

13. The process according to claim 12, wherein, said subjecting the vegetable oil residue to compression is carried out is carried out under a pressure of 0.5-3 MPa and a temperature of 30-50° C.

14. The process according to claim 12, wherein, said subjecting the vegetable oil residue to drying is carried out at a temperature of 80-110° C. for a period of 2-6 h to obtain a dried vegetable oil residue having a moisture content of less than 2 wt %, and after the first pulverization the dried vegetable oil residue has a median particle size of 50-300 μm, and after the second pulverization the dried vegetable oil residue has a median particle size of 30-50 μm and a bulk density of 1400-1600 kg/m$^3$.

15. The process according to claim 1, wherein the catalyst is selected from the group consisting of amorphous FeOOH, amorphous alumina loading an active component, biomass charcoal loading an active component, and any combination thereof, and wherein the active component is selected from the group consisting of oxides of metals of group VIB, group VIIB, group VIII, and any combination thereof in the periodic table of elements.

16. The process according to claim 15, wherein, the active component is selected from the group consisting of oxides of Mo, W, Fe, Co, Ni, Mn, Pd, and any combination thereof.

17. The process according to claim 1, wherein the catalyst is present in an amount of 1-10 wt % of the mass of the pretreated biomass, and has a particle size of 5-500 μm; and the vulcanizing agent is present in an amount of 0.1-0.4 wt % of the mass of the pretreated biomass.

18. The process according to claim 1, wherein, said introducing hydrogen into the slurry comprises:

introducing a high-pressure hydrogen into the slurry to prepare a reaction raw material mixture, wherein the high-pressure hydrogen and the slurry have a volume ratio of (600-1500):1; and heating the reaction raw material mixture to 380-480° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.02-0.2 m/s, preferably 0.05-0.08 m/s;

wherein, the high-pressure hydrogen has a pressure of 15-27 MPa, and the cold hydrogen has a temperature of 60-135° C.

19. The process according to claim 18, wherein said introducing the high-pressure hydrogen into the slurry comprises two steps of:

firstly, introducing a high-pressure hydrogen into the slurry till the volume ratio of the high-pressure hydrogen to the slurry is (50-200):1, and heating the slurry to 200-350° C., and secondly, introducing a high-pressure hydrogen into the slurry.

20. The process according to claim 18, wherein, the catalyst stored in the slurry bed reactor is controlled in an amount of 5-30 wt % of the mass of liquid phase in the slurry bed reactor; and the reaction is carried out for a period of 30-120 min.

21. The process according to claim 9, wherein, said introducing hydrogen into the slurry comprises:

introducing a high-pressure hydrogen into the slurry to prepare a reaction raw material mixture, wherein the high-pressure hydrogen and the slurry have a volume ratio of (600-1500):1; and heating the reaction raw material mixture to 300-400° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.02-0.2 m/s, preferably 0.05-0.08 m/s;

wherein, the high-pressure hydrogen has a pressure of 15-22 MPa, and the cold hydrogen has a temperature of 60-135° C.

22. The process according to claim 12, wherein, said introducing hydrogen into the slurry comprises:

introducing a high-pressure hydrogen into the slurry to prepare a reaction raw material mixture, wherein the high-pressure hydrogen and the slurry have a volume ratio of (600-1500):1; and heating the reaction raw material mixture to 340-420° C. and feeding it into a slurry bed reactor to undergo hydrolysis, cracking and hydrogenation reactions, and simultaneously introducing a cold hydrogen into the slurry bed reactor by controlling the slurry bed reactor to have a total gas velocity of 0.02-0.2 m/s;

wherein, the high-pressure hydrogen has a pressure of 15-22 MPa, and the cold hydrogen has a temperature of 60-135° C.

23. The process according to claim 21, wherein, said introducing the high-pressure hydrogen into the slurry comprises two steps of:

firstly, introducing a high-pressure hydrogen into the slurry till the volume ratio of the high-pressure hydrogen to the slurry is (50-200):1, and heating the slurry to 200-280° C., and secondly, introducing a high-pressure hydrogen into the slurry.

24. The process according to claim 21, wherein, the catalyst stored in the slurry bed reactor is controlled in an amount of 5-30 wt % of the mass of liquid phase in the slurry bed reactor; and the reaction is carried out for a period of 30-60 min.

25. Process for one-pot liquefaction of biomass, comprising the following steps:

preparing a biomass coal slurry by mixing a biomass powder, a coal powder, a catalyst, and a vulcanizing agent with a flowing medium, and perform grinding pulping, wherein the flowing medium is an oil or water; and wherein the biomass powder is prepared by collecting a biomass and controlling the biomass to have a moisture content of less than 2 wt %, then pulverizing the biomass to a median particle size of 100-300 μm, compressing and molding the pulverized biomass under a pressure of 2-5 MPa and a temperature of 30-60° C., and pulverizing the compressed biomass again to a median particle size of 30-50 μm; and wherein the coal powder is prepared by collecting a coal and controlling the coal to have a moisture content of less than 2 wt %, then pulverizing it to a median particle size of 50-100 μm under a temperature of 30-60° C., compressing and molding the pulverized coal under a pressure of 5-15 MPa, and pulverizing the compressed coal again;

carrying out a liquefaction reaction, comprising introducing hydrogen into the biomass coal slurry to carry out a reaction under a pressure of 15 to 25 MPa to finally obtain a bio-oil;

wherein, when the flowing medium is an oil, said preparing a biomass coal slurry comprises: firstly removing dust from the biomass powder and the coal powder, and premixing them with the catalyst and the vulcanizing agent to obtain a premix, and then mixing the premix with the oil; or directly mixing the biomass powder, the coal powder which is pulverized again to a median particle size of 30-50 μm, and the catalyst with the oil; and wherein the biomass powder and the coal powder account for 60-70 wt % of the mass of the biomass coal slurry; and the liquefaction reaction is carried out under a temperature of 380-460° C.; or wherein, when the flowing medium is water, said preparing a biomass coal slurry comprises: firstly removing dust from the biomass powder and the coal powder, and premixing them with the catalyst and the vulcanizing agent to obtain a premix, and then mixing the premix with water; or directly mixing the biomass powder, the coal powder which is pulverized again to a median particle size of 30-100 μm, the catalyst, and the vulcanizing agent with water; wherein, the biomass powder and the coal powder account for 55-65 wt % of the mass of the biomass coal slurry; and the liquefaction reaction is carried out under a temperature of 300-460° C.

26. The process according to claim 25, wherein, when the flowing medium is an oil, the biomass accounts for 20-30 wt % of the mass of the biomass coal slurry, and the coal powder accounts for 30-45 wt % of the mass of the biomass coal slurry; and when the flowing medium is water, the biomass accounts for 15-30 wt % of the mass of the biomass coal slurry, and the coal powder accounts for 35-50 wt % of the mass of the biomass coal slurry.

27. The process according to claim 25, wherein, the moisture content is controlled by drying and dehydrating under a temperature of 50-70° C. for a period of 3-5 h.

28. The process according to claim 25 wherein, said preparing a biomass coal slurry comprises controlling the biomass powder to have a bulk density of 300-500 kg/m$^3$, and controlling the coal powder to have a bulk density of 1000-1200 kg/m$^3$ when the flowing medium is an oil and a bulk density of 1200-1300 kg/m$^3$ when the flowing medium is water.

29. The process according to claim 25, wherein, the grinding pulping lasts for 2-8 min.

30. The process according to claim 25, wherein, the coal is low rank coal; the oil is selected from the group consisting of hogwash oil, gutter oil, rancid oil, waste lubricating oil, waste engine oil, heavy oil, residual oil, washing oil, anthracene oil, coal tar, petroleum, bio-oil produced by the present process, and any combination thereof.

31. The process according to claim 25, wherein, in the biomass coal slurry the catalyst is present in an amount of 1-10 wt %, preferably 1-4 wt %, of the total mass of the biomass and coal; and the catalyst has a particle size of 5-500 μm.

32. The process according to claim 25, wherein, said introducing hydrogen comprises:

introducing a high-pressure hydrogen into the biomass coal slurry to prepare a reaction raw material mixture, wherein the high-pressure hydrogen and the biomass coal slurry have a volume ratio of (600-1500):1; and heating the reaction raw material mixture to 320-450° C. and feeding it into a slurry bed reactor to undergo liquidation, cracking and hydrogenation reactions, and simultaneously introducing a cold hydrogen into the slurry bed reactor by controlling the slurry bed reactor to have a total gas velocity of 0.02-0.2 m/s, preferably 0.05-0.08 m/s;

wherein, the high-pressure hydrogen has a pressure of 13-27 MPa, and the cold hydrogen has a temperature of 60-135° C.

33. The process according to claim 32, wherein, said introducing the high-pressure hydrogen into the biomass coal slurry comprises two steps of:

firstly, introducing a high-pressure hydrogen into the biomass coal slurry till the volume ratio of the high-pressure hydrogen to the biomass coal slurry is (50-200):1, and heating the biomass coal slurry to 200-350° C., and secondly, introducing a high-pressure hydrogen into the biomass coal slurry.

34. The process according to claim 32, wherein, the catalyst stored in the slurry bed reactor is controlled in an amount of 5-30 wt % of the mass of liquid phase in the slurry bed reactor.

35. The process according to claim 25, wherein, the liquefaction reaction lasts for 30-90 min when the flowing medium is an oil, and lasts for 30-60 min when the flowing medium is water.

36. The process according to claim 25, wherein, the catalyst comprises:

amorphous alumina loading a first active component, or biomass charcoal loading a first active component, wherein the first active component is selected from the group consisting of oxides of metals of group VIB, group VIIB or group VIII, and any combination thereof in the periodic table of elements.

37. The process according to claim 25, wherein, the catalyst further comprises:

amorphous FeOOH, and/or biomass charcoal loading a second active component, wherein the second active component is selected from the group consisting of oxides of Mo, W, Fe, Co, Ni, Pd, and any combination thereof.

* * * * *